US008870317B2

(12) United States Patent
Kobayashi et al.

(10) Patent No.: US 8,870,317 B2
(45) Date of Patent: Oct. 28, 2014

(54) IMAGE FORMING APPARATUS INCLUDING RECORDING HEAD AND HEAD TANK

(71) Applicants: Takeyuki Kobayashi, Kanagawa (JP); Suguru Masunaga, Kanagawa (JP)

(72) Inventors: Takeyuki Kobayashi, Kanagawa (JP); Suguru Masunaga, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 50 days.

(21) Appl. No.: 13/680,365

(22) Filed: Nov. 19, 2012

(65) Prior Publication Data

US 2013/0147867 A1 Jun. 13, 2013

(30) Foreign Application Priority Data

Dec. 8, 2011 (JP) ..... 2011-268585

(51) Int. Cl.

| | |
|---|---|
| ***B41J 2/195*** | (2006.01) |
| ***B41J 29/38*** | (2006.01) |
| ***B41J 2/17*** | (2006.01) |
| ***B41J 2/175*** | (2006.01) |

(52) U.S. Cl.

CPC ..... *B41J 2/17566* (2013.01); *B41J 2/17556* (2013.01); *B41J 29/38* (2013.01); *B41J 2/175* (2013.01); *B41J 2/17513* (2013.01); *B41J 2/17509* (2013.01)

USPC ..... 347/7; 347/6; 347/16; 347/84; 347/85

(58) Field of Classification Search

USPC ..... 347/6, 7, 16, 84, 85

See application file for complete search history.

(56) References Cited

U.S. PATENT DOCUMENTS

2011/0164077 A1* 7/2011 Masunaga ..... 347/6

FOREIGN PATENT DOCUMENTS

| | | |
|---|---|---|
| JP | 2011-207206 | 10/2011 |
| WO | WO 2011111759 A1 * | 9/2011 |
| WO | WO 2012/023416 A1 | 2/2012 |

OTHER PUBLICATIONS

U.S. Appl. No. 13/467,418, filed May 9, 2012, Takeyuki Kobayashi et al.
U.S. Appl. No. 13/517,795, filed Jun. 14, 2012, Suguru Masunaga.
U.S. Appl. No. 13/600,135, filed Aug. 30, 2012, Suguru Masunaga et al.
U.S. Appl. No. 13/666,199, filed Nov. 1, 2012, Takeyuki Kobayashi et al.
U.S. Appl. No. 13/667,465, filed Nov. 2, 2012, Suguru Masunaga et al.
U.S. Appl. No. 13/577,834, filed Aug. 8, 2012, Takeyuki Kobayashi.

* cited by examiner

*Primary Examiner* — Sarah Al Hashimi
(74) *Attorney, Agent, or Firm* — Cooper & Dunham LLP

(57) ABSTRACT

An image forming apparatus includes an apparatus body, a recording head, a head tank, a carriage, a main tank, a liquid feed device, a supply controller, a displacement member, a first detector, and a second detector. When a consumption amount of liquid in the head tank reaches a threshold value, the controller controls the feed device to start supplying the liquid from the main tank to the head tank. When printing operation is not performed and the displacement member is at a position at which a remaining amount of the liquid in the head tank is smaller than when the displacement member is at a first position, the controller controls the feed device to supply the liquid until the displacement member is placed at the first position or a position at which the remaining amount of the liquid is greater than when the displacement member is at the first position.

10 Claims, 19 Drawing Sheets

IMAGE FORMING APPARATUS INCLUDING RECORDING HEAD AND HEAD TANK

CROSS-REFERENCE TO RELATED APPLICATIONS

This patent application is based on and claims priority pursuant to 35 U.S.C. §119 to Japanese Patent Application No. 2011-268585, filed on Dec. 8, 2011, in the Japan Patent Office, the entire disclosure of which is hereby incorporated by reference herein.

BACKGROUND

1. Technical Field

This disclosure relates to an image forming apparatus, and more specifically to an image forming apparatus including a recording head for ejecting liquid droplets and a head tank for supplying liquid to the recording head.

2. Description of the Related Art

Image forming apparatuses are used as printers, facsimile machines, copiers, plotters, or multi-functional devices having two or more of the foregoing capabilities. As one type of image forming apparatus employing a liquid-ejection recording method, an inkjet recording apparatus is known that uses a recording head (liquid ejection head or liquid-droplet ejection head) for ejecting droplets of ink or other liquid.

To replenish and supply liquid from a main tank to a head tank (also referred to as "sub tank") mounted on the recording head even during printing operation, such an image forming apparatus may have a displacement member (hereinafter also referred to as "feeler") mounted on the head tank and displaceable with the remaining amount of liquid in the head tank, a first sensor mounted on a carriage to detect that the displacement member is at a predetermined first position, and a second sensor mounted on an apparatus body to detect that the displacement member is at a predetermined second position. The image forming apparatus detects and retains a differential supply amount corresponding to a displacement amount of the displacement member between the first position and the second position. In supplying liquid from the main tank to the head tank without using the second sensor on the apparatus body, the image forming apparatus supplies liquid to the head tank by the differential supply amount after detection of the displacement member with the first sensor (see JP-2011-207206-A).

For the configuration described in JP-2011-207206-A, in a case in which the displacement member is between the first position detected with the first detector and a supply start position (referred to as "third position") while the image forming apparatus is halted or turned off for a long time after printing operation, the position of the displacement member may change due to changes in the ambient environment or permeability of a liquid supply passage including the head tank. As a result, when the next printing operation starts, the actual position of the displacement member may differ from an assumed position of the displacement member corresponding to the consumption amount of liquid at the end of the previous printing operation.

If the next printing operation is performed from the actual position differing from the assumed position until the third position is detected, an excessive negative pressure in the head tank may cause degraded print quality or air sucked into nozzles may cause ejection failure. In addition, when the displacement member is at a position at which the remaining amount of liquid in the head tank is greater than when the displacement member is at the first position, an excessive amount of liquid may be supplied, thus causing liquid leakage from nozzles.

BRIEF SUMMARY

In an aspect of this disclosure, there is provided an image forming apparatus including an apparatus body, a recording head, a head tank, a carriage, a main tank, a liquid feed device, a supply controller, a displacement member, a first detector, and a second detector. The recording head ejects liquid droplets. The head tank stores liquid to be supplied to the recording head. The carriage mounts the recording head and the head tank. The main tank stores the liquid to be supplied to the head tank. The liquid feed device supplies the liquid from the main tank to the head tank. The supply controller controls driving of the liquid feed device to supply the liquid from the main tank to the head tank. The displacement member is provided at the head tank and is displaceable with a remaining amount of the liquid in the head tank. The first detector is mounted on the carriage to detect a first position of the displacement member. The second detector is mounted on the apparatus body to detect a second position of the displacement member. The supply controller detects and retains a differential supply amount corresponding to a displacement amount of the displacement member between the first position and the second position. When the first position of the displacement member is detected with the first detector, the remaining amount of the liquid in the head tank is smaller than when the second position of the displacement member is detected with the second detector. When the liquid is supplied from the main tank to the head tank without using the second detector during printing operation, the supply controller measures a consumption amount of the liquid in the head tank consumed while the displacement member displaces from the first position detected with the first detector in a direction in which the remaining amount of the liquid in the head tank decreases. When the consumption amount of the liquid reaches a predetermined threshold value, the supply controller controls the liquid feed device to start supplying the liquid from the main tank to the head tank. After the first detector detects the displacement member, the supply controller controls the liquid feed device to supply the liquid by the differential supply amount from the main tank to the head tank. When the printing operation is not performed and the displacement member is at a position at which the remaining amount of the liquid in the head tank is smaller than when the displacement member is at the first position, the supply controller controls the liquid feed device to supply the liquid until the displacement member is placed at the first position or a position at which the remaining amount of the liquid in the head tank is greater than when the displacement member is at the first position.

In another aspect of this disclosure, there is provided an image forming apparatus including an apparatus body, a recording head, a head tank, a carriage, a main tank, a liquid feed device, a supply controller, a displacement member, a first detector, and a second detector. The recording head ejects liquid droplets. The head tank stores liquid to be supplied to the recording head. The carriage mounts the recording head and the head tank. The main tank stores the liquid to be supplied to the head tank. The liquid feed device supplies the liquid from the main tank to the head tank. The supply controller controls driving of the liquid feed device to supply the liquid from the main tank to the head tank. The displacement member is provided at the head tank and is displaceable with a remaining amount of the liquid in the head tank. The first detector is mounted on the carriage to detect a first position of the displacement member. The second detector is mounted on the apparatus body to detect a second position of the displacement member. The supply controller detects and retains a differential supply amount corresponding to a displacement amount of the displacement member between the first position and the second position. When the first position of the displacement member is detected with the first detector, the remaining amount of the liquid in the head tank is smaller than when the second position of the displacement member is detected with the second detector. When the liquid is supplied from the main tank to the head tank without using the second detector during printing operation, the supply controller measures a consumption amount of the liquid in the head tank consumed while the displacement member displaces from the first position detected with the first detector in a direction in which the remaining amount of the liquid in the head tank decreases. When the consumption amount of the liquid reaches a predetermined threshold value, the supply controller controls the liquid feed device to start supplying the liquid from the main tank to the head tank. After the first detector detects the displacement member, the supply controller controls the liquid feed device to supply the liquid by the differential supply amount from the main tank to the head tank. When, during scanning of the carriage, the recording head contacts a recording medium on which the recording head forms an image, the supply controller detects the differential supply amount. When the displacement member is at a position at which the remaining amount of the liquid in the head tank is smaller than when the displacement member is at the first position, the supply controller controls the liquid feed device to supply the liquid until the displacement member is placed at the first position or a position at which the remaining amount of the liquid in the head tank is greater than when the displacement member is at the first position. When the supply controller detects that the displacement member is at the position at which the remaining amount of the liquid in the head tank is greater than when the displacement member is at the first position, the supply controller controls the liquid feed device to reduce the liquid in the head tank until the second detector detects the second position or the first detector detects the first position of the displacement member.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1:
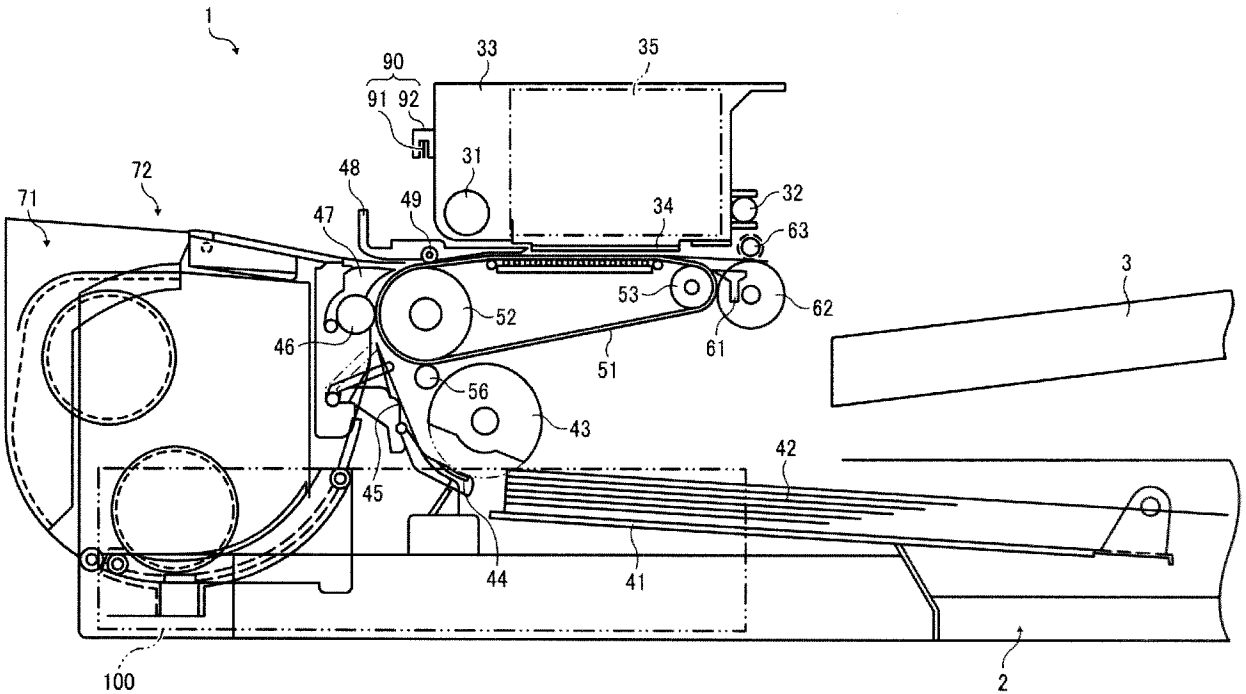
FIG. 1 is a schematic side view of a mechanical section of an image forming apparatus according to an exemplary embodiment of this disclosure.

The accompanying drawings are intended to depict exemplary embodiments of the present disclosure and should not be interpreted to limit the scope thereof. The accompanying drawings are not to be considered as drawn to scale unless explicitly noted.

DETAILED DESCRIPTION OF EXEMPLARY EMBODIMENTS

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

For example, in this disclosure, the term "sheet" used herein is not limited to a sheet of paper and includes anything such as OHP (overhead projector) sheet, cloth sheet, glass sheet, or substrate on which ink or other liquid droplets can be attached. In other words, the term "sheet" is used as a generic term including a recording medium, a recorded medium, a recording sheet, and a recording sheet of paper. The terms "image formation", "recording", "printing", "image recording" and "image printing" are used herein as synonyms for one another.

The term "image forming apparatus" refers to an apparatus that ejects liquid on a medium to form an image on the medium. The medium is made of, for example, paper, string, fiber, cloth, leather, metal, plastic, glass, timber, and ceramic. The term "image formation" includes providing not only meaningful images such as characters and figures but meaningless images such as patterns to the medium (in other words, the term "image formation" also includes only causing liquid droplets to land on the medium).

The term "ink" is not limited to "ink" in a narrow sense, unless specified, but is used as a generic term for any types of liquid useable as targets of image formation. For example, the term "ink" includes recording liquid, fixing solution, DNA sample, resist, pattern material, resin, and so on.

The term "image" used herein is not limited to a two-dimensional image and includes, for example, an image applied to a three dimensional object and a three dimensional object itself formed as a three-dimensionally molded image.

The term "image forming apparatus", unless specified, also includes both serial-type image forming apparatus and line-type image forming apparatus.

Although the exemplary embodiments are described with technical limitations with reference to the attached drawings, such description is not intended to limit the scope of the invention and all of the components or elements described in the exemplary embodiments of this disclosure are not necessarily indispensable to the present invention.

Referring now to the drawings, wherein like reference numerals designate identical or corresponding parts throughout the several views, exemplary embodiments of the present disclosure are described below.

First, an image forming apparatus according to an exemplary embodiment of this disclosure is described with reference to FIGS. 1 and 2.

FIG. 1 is a side view of an entire configuration of the image forming apparatus. FIG. 2 is a plan view of the image forming apparatus.

In this exemplary embodiment, the image forming apparatus is described as a serial-type inkjet recording apparatus. It is to be noted that the image forming apparatus is not limited to such a serial-type inkjet recording apparatus and may be any other type image forming apparatus.

Figure 2:
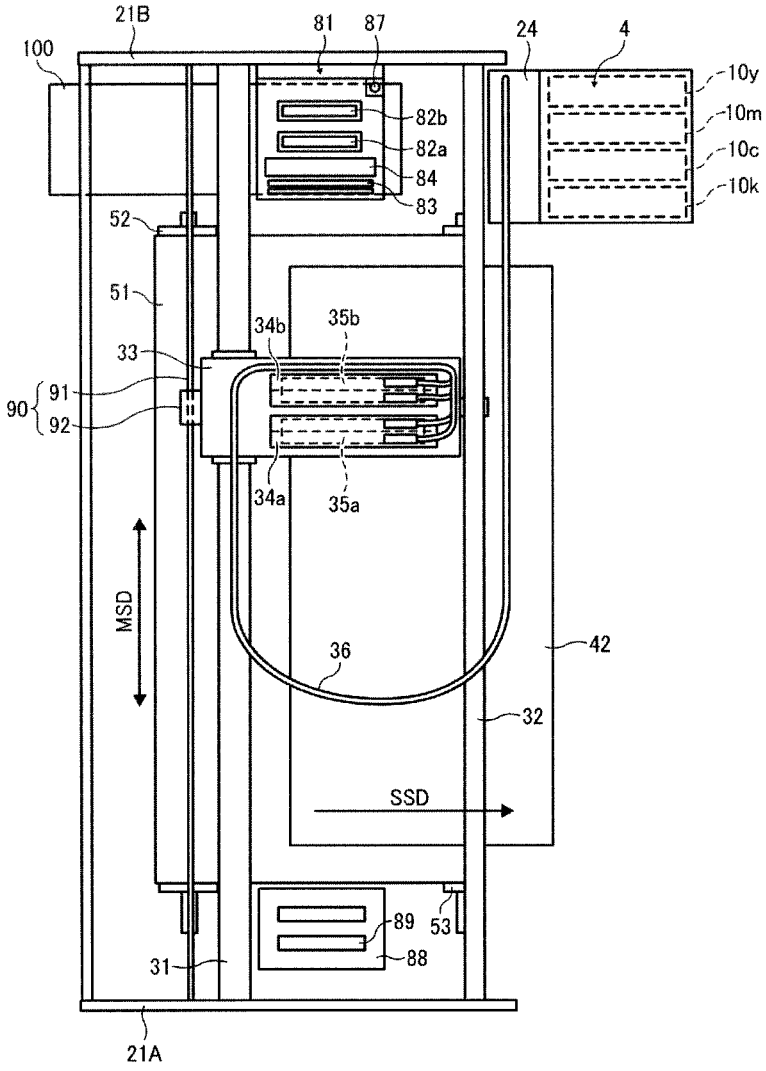
FIG. 2 is a partial plan view of the mechanical section of FIG. 1.

In the image forming apparatus, a carriage 33 is supported by a main guide rod 31 and a sub guide rod 32 so as to be movable in a direction (main scanning direction) indicated by an arrow MSD in FIG. 2. The main guide rod 31 and the sub guide rod 32 serving as guide members extend between a left side plate 21A and a right side plate 21B of an apparatus body 1. The carriage 33 is reciprocally moved for scanning in the main scanning direction MSD by a main scanning motor via a timing belt.

The carriage 33 mounts recording heads 34*a* and 34*b* (collectively referred to as "recording heads 34" unless distinguished) formed with liquid ejection heads for ejecting ink droplets of different colors, e.g., yellow (Y), cyan (C), magenta (M), and black (K). The recording heads 34*a* and 34*b* are mounted on the carriage 33 so that nozzle rows, each of which includes multiple nozzles, are arranged in parallel to a direction (sub scanning direction) perpendicular to the main scanning direction and ink droplets are ejected downward from the nozzles.

Each of the recording heads 34 has two nozzle rows. For example, one of the nozzles rows of the recording head 34*a* ejects liquid droplets of black (K) and the other ejects liquid droplets of cyan (C). In addition, one of the nozzles rows of the recording head 34*b* ejects liquid droplets of magenta (M) and the other ejects liquid droplets of yellow (Y).

The carriage 33 mounts head tanks 35*a* and 35*b* (collectively referred to as "head tanks 35" unless distinguished) to supply the respective color inks to the corresponding nozzle rows. A supply pump unit 24 supplies (replenishes) the respective color inks from ink cartridges 10*y*, 10*m*, 10*c*, and 10*k* removably mountable in a cartridge mount portion 4 to the head tanks 35 via supply tubes 36 dedicated for the respective color inks.

An encoder scale 91 is disposed so as to extend along the main scanning direction MSD of the carriage 33. The carriage 33 mounts an encoder sensor 92 to read the encoder scale 91. The encoder scale 91 and the encoder sensor 92 form a linear encoder 90. The main scanning position (carriage position) and movement amount of the carriage 33 are detected by detection signals of the linear encoder 90.

The image forming apparatus further includes a sheet feed section to feed sheets 42 stacked on a sheet stack portion (platen) 41 of a sheet feed tray 2. The sheet feed section further includes a sheet feed roller 43 and a separation pad 44. The sheet feed roller 43 has a substantially half moon shape to separate the sheets 42 from the sheet stack portion 41 and feed the sheets 42 sheet by sheet. The separation pad 44 made of a material of a high friction coefficient is disposed opposing the sheet feed roller 43 and urged toward the sheet feed roller 43.

To feed the sheets 42 from the sheet feed section to a position below the recording heads 34, the image forming apparatus includes a first guide member 45 to guide the sheet 42, a counter roller 46, a conveyance guide member 47, a pressing member 48 including a front-end pressing roller 49, and a conveyance belt 51 to attract the sheet 42 thereon by static electricity and convey the sheet 42 to a position opposing the recording heads 34.

The conveyance belt 51 is an endless belt that is looped between a conveyance roller 52 and a tension roller 53 so as to circulate in a belt conveyance direction (sub-scanning direction indicated by an arrow SSD in FIG. 2). The image forming apparatus also has a charging roller 56 serving as a charger to charge the surface of the conveyance belt 51. The charging roller 56 is disposed so as to contact an outer surface of the conveyance belt 51 and rotate with the circulation of the conveyance belt 51. The conveyance roller 52 is rotated by a sub scanning motor via a timing belt, so that the conveyance belt 51 circulates in the belt conveyance direction.

The image forming apparatus further includes a sheet output section that outputs the sheet 42 on which an image has been formed by the recording heads 34. The sheet output section includes a separation claw 61 to separate the sheet 42 from the conveyance belt 51, a first output roller 62, a spur 63 serving as a second output roller, and a sheet output tray 3 disposed at a position lower than the first output roller 62.

A duplex unit 71 is detachably mounted on a rear face portion of the apparatus body 1. When the conveyance belt 51 rotates in reverse to return the sheet 42, the duplex unit 71 receives the sheet 42. Then the duplex unit 71 reverses and feeds the sheet 42 to a nipping portion between the counter roller 46 and the conveyance belt 51. A manual-feed tray 72 is formed at an upper face of the duplex unit 71.

As illustrated in FIG. 2, a maintenance device (maintenance and recovery device) 81 is disposed in a non-printing area (non-recording area) at one end in the main scanning direction of the carriage 33. The maintenance device 81 maintains and recovers nozzle conditions of the recording heads 34. The maintenance device 81 includes caps 82*a* and 82*b*, a wiping member 83, a first dummy-ejection receptacle 84, and a carriage lock 87. The caps 82*a* and 82*b* (hereinafter collectively referred to as "caps 82" unless distinguished) cap the nozzle faces of the recording heads 34. The wiping member (wiper blade) 83 wipes the nozzle faces of the recording heads 34. The first dummy-ejection receptacle 84 receives liquid droplets ejected by dummy ejection in which liquid droplets not contributing to image recording are ejected to remove increased-viscosity recording liquid. The carriage lock 87 locks the carriage 33. Below the maintenance device 81, a waste liquid tank 100 is removably mounted to the apparatus body 1 to store waste ink or liquid discharged by the maintenance and recovery operation.

As illustrated in FIG. 2, a second dummy ejection receptacle 88 is disposed at a non-printing area on the opposite end in the main scanning direction of the carriage 33. The second dummy ejection receptacle 88 receives liquid droplets ejected, e.g., during recording (image forming) operation by dummy ejection in which liquid droplets not contributing to image recording are ejected to remove increased-viscosity recording liquid. The second dummy ejection receptacle 88 has openings 89 arranged in parallel to the nozzle rows of the recording heads 34.

In the image forming apparatus having the above-described configuration, the sheet 42 is separated sheet by sheet from the sheet feed tray 2, fed in a substantially vertically upward direction, guided along the first guide member 45, and conveyed while being sandwiched between the conveyance belt 51 and the counter roller 46. Further, the front end of the sheet 42 is guided by the conveyance guide member 47 and is pressed against the conveyance belt 51 by the front-end pressing roller 49 to turn the transport direction of the sheet 42 by approximately 90°.

At this time, positive and negative voltages are alternately supplied to the charging roller 56 so that plus outputs and minus outputs to the charging roller 56 are alternately repeated. As a result, the conveyance belt 51 is charged in an alternating voltage pattern, that is, so that positively charged areas and negatively charged areas are alternately repeated at a certain width in the sub-scanning direction SSD, i.e., the belt conveyance direction. When the sheet 42 is fed onto the conveyance belt 51 alternately charged with positive and negative charges, the sheet 42 is attracted on the conveyance belt 51 and conveyed in the sub scanning direction by the circulation of the conveyance belt 51.

By driving the recording heads 34 in accordance with image signals while moving the carriage 33, ink droplets are ejected onto the sheet 42, which is stopped below the recording heads 34, to form one line of a desired image. Then, the sheet 42 is fed by a certain distance to prepare for the next operation to record another line of the image. Receiving a recording end signal or a signal indicating that the rear end of the sheet 42 has arrived at the recording area, the recording operation finishes and the sheet 42 is output to the sheet output tray 3.

To perform maintenance and recovery operation on the nozzles of the recording heads 34, the carriage 33 is moved to a home position at which the carriage 33 opposes the maintenance device 81. Then, the maintenance-and-recovery operation, such as nozzle sucking operation for sucking ink from nozzles with the nozzle faces of the recording heads 34 capped with the caps 82 and/or dummy ejection for ejecting liquid droplets not contributed to image formation, is performed, thus allowing image formation with stable droplet ejection.

Next, an example of the head tank 35 is described with reference to FIGS. 3 and 4.

Figure 3:
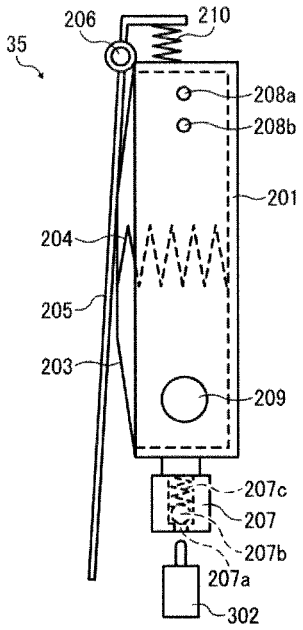
FIG. 3 is a schematic plan view of an example of a head tank of the image forming apparatus.
Figure 4:
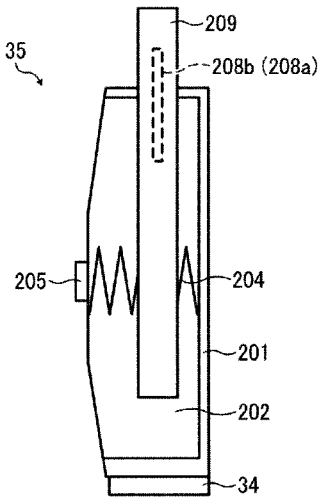
FIG. 4 is a schematic front cross sectional view of the head tank illustrated in FIG. 3.

FIG. 3 is a schematic plan view of the head tank 35 corresponding to one nozzle row. FIG. 4 is a schematic front view of the head tank 35 of FIG. 3.

The head tank 35 has a tank case 201 fanning an ink storage part to store ink and having an opening at one side. The opening of the tank case 201 is sealed with a film member 203 serving as a flexible member, and the film member 203 is constantly urged outward by a restoring force of a spring 204 serving as an elastic member disposed in the tank case 201. Thus, since the restoring force of the spring 204 acts on the film member 203 of the tank case 201, the remaining amount of ink in the ink storage part 202 of the tank case 201 decreases, thus creating negative pressure.

At the exterior of the tank case 201, a displacement member (hereinafter, may also be referred to as simply "feeler") 205 formed with a feeler having one end swingably supported by a support shaft 206 is fixed on the film member 203 by, e.g., adhesive. The displacement member 205 is urged toward the tank case 201 by a spring 210 and displaces with movement of the film member 203. By detecting the displacement member 205 with, e.g., a first detector (first sensor) 251 mounted on the carriage 33 or a second detector (second sensor) 301 disposed at the apparatus body 1, the remaining amount of ink or negative pressure in the head tank 35 can be detected.

A supply port portion 209 is disposed at an upper portion of the tank case 201 and connected to the supply tube 36 to supply ink from the ink cartridge 10. At one side of the tank case 201, an air release unit 207 is disposed to release the interior of the head tank 35 to the atmosphere. The air release unit 207 includes an air release passage 207*a* communicating with the interior of the head tank 35, a valve body 207*b* to open and close the air release passage 207*a*, and a spring 207*c* to urge the valve body 207*b* into a closed state. An air release solenoid 302 is disposed at the apparatus body 1, and the valve body 207*b* is pushed by the air release solenoid 302 to open the air release passage 207*a*, thus causing the interior of the head tank 35 to be opened to the atmosphere (in other words, causing the interior of the head tank 35 to communicate with the atmosphere).

Electrode pins 208*a* and 208*b* are mounted in the head tank 35 to detect the height of the liquid level of ink in the head tank 35. Since ink has conductivity, when ink reaches the electrode pins 208*a* and 208*b*, electric current flows between the electrode pins 208*a* and 208*b* and the resistance values of the electrode pins 208*a* and 208*b* change. Such a configuration can detect that the liquid level of ink decreases to a threshold level or lower, i.e., the amount of air in the head tank 35 has increased to a threshold amount or more.

Figure 5:
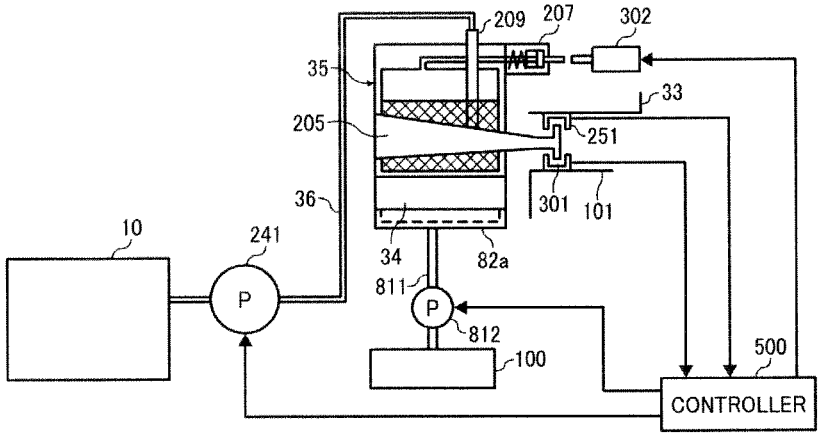
FIG. 5 is a schematic view of an ink supply-and-discharge system of the image forming apparatus.

Next, an ink supply-and-discharge system of the image forming apparatus is described with reference to FIG. 5.

A liquid feed pump 241 serving as a liquid feed device of the supply pump unit 24 supplies ink from the ink cartridge 10 (hereinafter, main tank) to the head tank 35 via the supply tube 36. The liquid feed pump 241 is a bidirectional pump, e.g., a tube pump, capable of supplying ink from the ink cartridge 10 to the head tank 35 and returning ink from the head tank 35 to the ink cartridge 10.

The maintenance device 81, as described above, has the cap 82*a* to cover the nozzle face of the recording head 34 and a suction pump 812 connected to the cap 82*a*. The suction pump 812 is driven with the nozzle face capped with the cap 82*a* to suck ink from the nozzles via a suction tube 811, thus allowing ink to be sucked from the head tank 35. Waste ink sucked from the head tank 35 is discharged to a waste liquid tank 100.

The air release solenoid 302 serving as a pressing member to open and close the air release unit 207 of the head tank 35 is disposed at the apparatus body 1. By activating the air release solenoid 302, the air release unit 207 can be opened.

At the carriage 33 is mounted the first sensor 251 that is an optical sensor serving as the first detector to detect the displacement member 205. At the apparatus body 1 is disposed the second sensor 301 that is an optical sensor serving as the second detector to detect the displacement member 205. As described below, ink supply operation for supplying ink to the head tank 35 is controlled based on detection results of the first sensor 251 and the second sensor 301.

The driving control of the liquid feed pump 241, the air release solenoid 302, and the suction pump 812 and the ink supply control according to exemplary embodiments of this disclosure are performed by the controller 500.

Next, different examples of the arrangement of the first and second sensors are described with reference to FIGS. 6 and 7.

Figure 6:
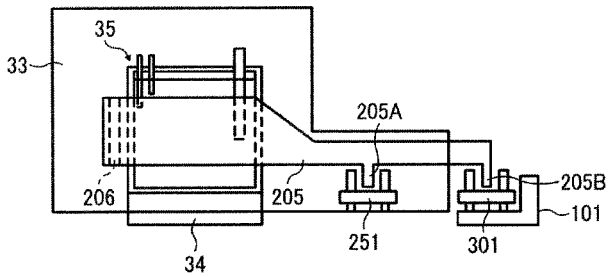
FIG. 6 is a schematic view of a first example of arrangement of first and second sensors.
Figure 7:
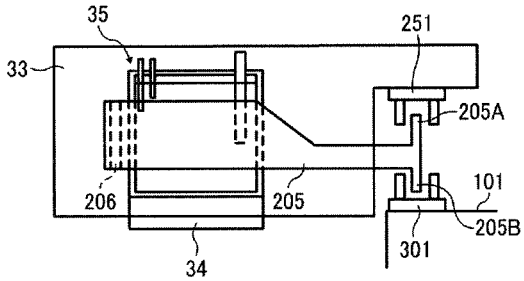
FIG. 7 is a schematic view of a second example of arrangement of the first and second sensors.

FIGS. 6 and 7 are schematic views of different examples of the arrangement of the first and second sensors.

In the example illustrated in FIG. 6, the displacement member 205 of the head tank 35 has detected portions 205A and 205B projecting downward at positions away at different distances from the support shaft 206 (pivot axis). The first sensor 251 of the carriage 33 detects the detected portion 205A, and the second sensor 301 disposed at a member (base member) 101 of the apparatus body 1 detects the detected portion 205B.

In the example illustrated in FIG. 7, the displacement member 205 of the head tank 35 has detected portions 205A and 205B projecting upward and downward, respectively, at positions away at the same distance from the support shaft 206 (pivot axis). The first sensor 251 of the carriage 33 detects the detected portion 205A, and the second sensor 301 disposed at a member (base member) 101 of the apparatus body 1 detects the detected portion 205B.

Next, an outline of the controller of the image forming apparatus is described with reference to FIG. 8.

Figure 8:
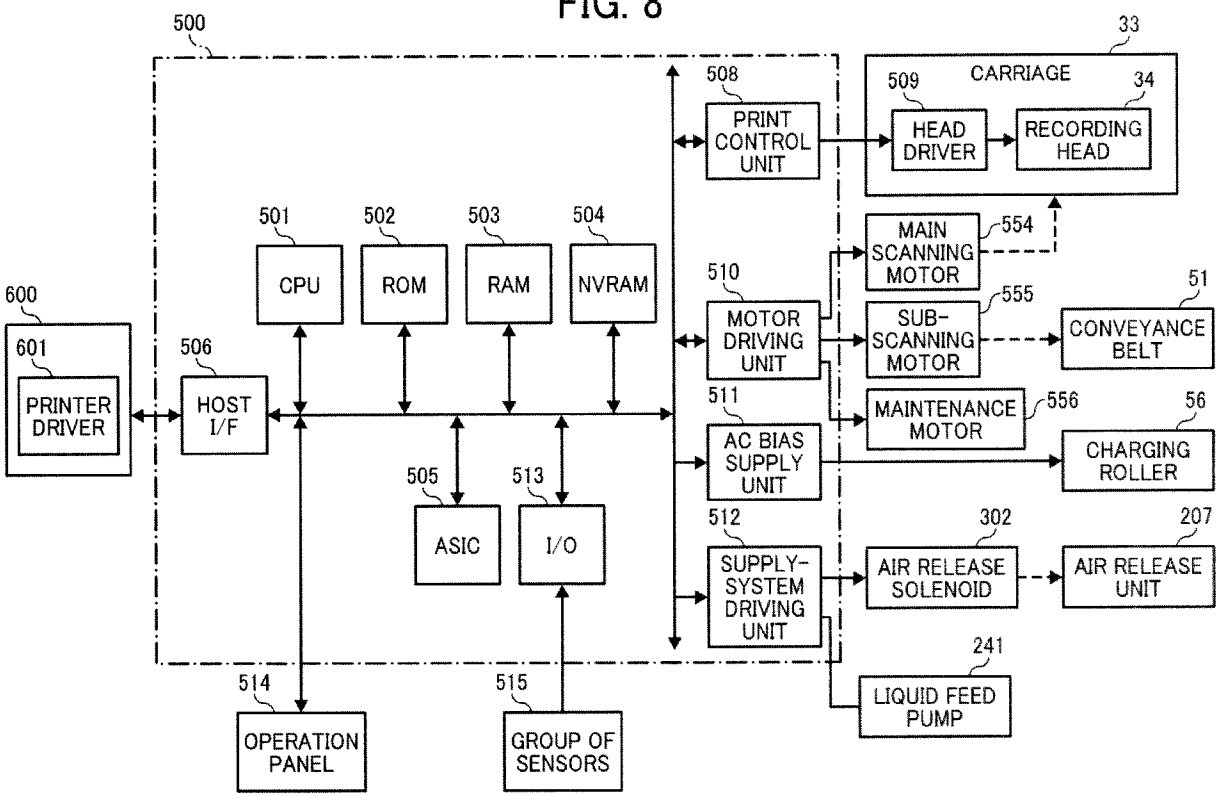
FIG. 8 is a schematic block diagram of a controller of the image forming apparatus.

FIG. 8 is a block diagram of the controller 500 of the image forming apparatus.

The controller 500 includes a central processing unit (CPU) 501 a read-only memory (ROM) 502, a random access memory (RAM) 503, a non-volatile random access memory (NVRAM) 504, and an application-specific integrated circuit (ASIC) 505. The CPU 501 manages the control of the entire image forming apparatus and serves as various control units including a supply control unit according to exemplary embodiments of this disclosure. The ROM 502 stores programs executed by the CPU 501 and other fixed data, and the RAM 503 temporarily stores image data and other data. The NVRAM 504 is a rewritable memory capable of retaining data even when the apparatus is powered off. The ASIC 505 processes various signals on image data, performs sorting or other image processing, and processes input and output signals to control the entire apparatus.

The controller 500 also includes a print control unit 508, a head driver (driver integrated circuit) 509, a main scanning motor 554, a sub-scanning motor 555, a motor driving unit 510, an alternating current (AC) bias supply unit 511, and a supply-system driving unit 512. The print control unit 508 includes a data transmitter and a driving signal generator to drive and control the recording heads 34 according to print data. The head driver 509 drives the recording heads 34 mounted on the carriage 33. The motor driving unit 510 drives the main scanning motor 554 to move the carriage 33 for scanning, drives the sub-scanning motor 555 to circulate the conveyance belt 51, and drives the maintenance motor 556 of the maintenance device 81. The AC bias supply unit 511 supplies AC bias to the charging roller 56. The supply-system driving unit 512 drives the liquid feed pump 241 and the air release solenoid 302 disposed at the apparatus body 1 to open and close the air release unit 207 of the head tank 35.

The controller 500 is connected to an operation panel 514 for inputting and displaying information necessary to the image forming apparatus.

The controller 500 includes a host interface (I/F) 506 for transmitting and receiving data and signals to and from a host 600, such as an information processing device (e.g., personal computer), image reading device (e.g., image scanner), or imaging device (e.g., digital camera), via a cable or network.

The CPU 501 of the controller 500 reads and analyzes print data stored in a reception buffer of the host I/F 506, performs desired image processing, data sorting, or other processing with the ASIC 505, and transfers image data to the head driver 509. Dot-pattern data for image output may be created by a printer driver 601 of the host 600.

The print control unit 508 transfers the above-described image data as serial data and outputs to the head driver 509, for example, transfer clock signals, latch signals, and control signals required for the transfer of image data and determination of the transfer. In addition, the print control unit 508 has the driving signal generator including, e.g., a digital/analog (D/A) converter (to perform digital/analog conversion on pattern data of driving pulses stored on the ROM 502), a voltage amplifier, and a current amplifier, and outputs a driving signal containing one or more driving pulses to the head driver 509.

In accordance with serially-inputted image data corresponding to one image line recorded by the recording heads 34, the head driver 509 selects driving pulses forming driving signals transmitted from the print control unit 508 and applies the selected driving pulses to driving elements (e.g., piezoelectric elements) to drive the recording heads 34. At this time, the driving elements serve as pressure generators to generate energy for ejecting liquid droplets from the recording heads 34. At this time, by selecting a part or all of the driving pulses forming the driving signals, the recording heads 34 can selectively eject different sizes of droplets, e.g., large droplets, medium droplets, and small droplets to form different sizes of dots on a recording medium.

An input/output (I/O) unit 513 obtains information from a group of sensors 515 mounted in the image forming apparatus, extracts information required for controlling printing operation, and controls the print control unit 508, the motor driving unit 510, the AC bias supply unit 511, and ink supply to the head tanks 35 based on the extracted information.

Besides the first sensor 251, the second sensor 301, and the detection electrode pins 208*a* and 208*b*, the group of sensors 515 includes, for example, an optical sensor to detect the position of the sheet of recording media, a thermistor (environment temperature and/or humidity sensor) to monitor temperature and/or humidity in the apparatus, a voltage sensor to monitor the voltage of the charged belt, and an interlock switch to detect the opening and closing of a cover. The I/O unit 513 is capable of processing various types of information transmitted from the group of sensors.

Next, position detection of the displacement member 205 of the head tank 35 is described with reference to FIGS. 9A, 9B, and 10.

Figure 9A:
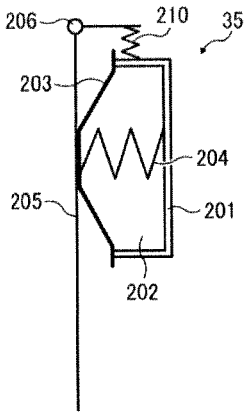
FIGS. 9A and 9B are schematic views of displacement of a displacement member of the head tank.
Figure 9B:
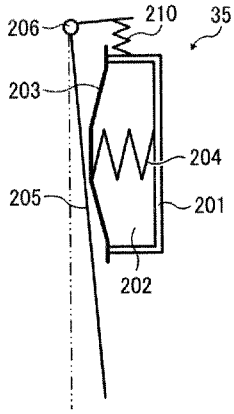

FIGS. 9A and 9B are schematic views of displacement of a displacement member of the head tank. FIG. 10 shows an example of the position detection of the displacement member 205 of the head tank 35. It is to be noted that, in FIG. 11 and subsequent drawings, the head tank is illustrated in a simplified form like FIGS. 9A, 9B, and 10.

In response with the remaining amount of liquid in the head tank 35, the displacement member 205 of the head tank 35 displaces between a position indicated by a solid line in FIG. 9A (i.e., a broken line in FIG. 9B) and a position indicated by a solid line in FIG. 9B.

Figure 10:
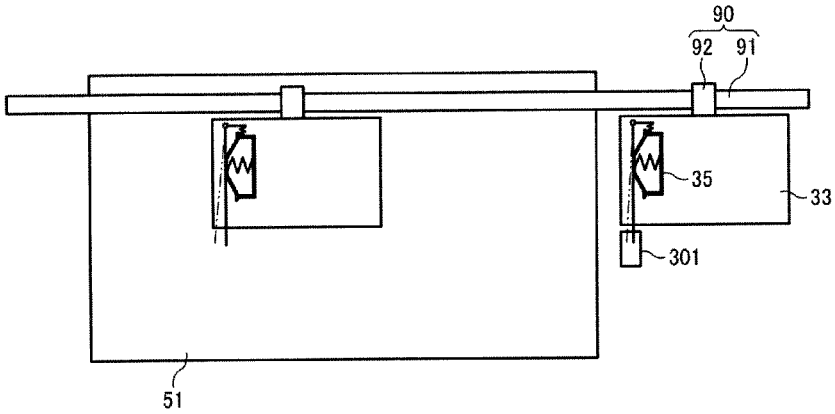
FIG. 10 is a schematic plan view of position detection of displacement member of the head tank.

Hence, as illustrated in FIG. 10, when the second sensor 301 on the apparatus body 1 side detects the displacement member 205 of the head tank 35, the linear encoder 90 stores a position of the carriage 33. When the displacement member 205 of the head tank 35 displaces, the carriage 33 continues moving until the second sensor 301 detects the displacement member 205 of the head tank 35 again. When the second sensor 301 detects the displacement member 205 of the head tank 35 again, the linear encoder 90 reads another position of the carriage 33, thus allowing detection of the positions and displacement amount of the displacement member 205 as a difference between the positions of the carriage.

At this time, if a remaining amount of liquid in the head tank 35 corresponding to an initial position of the displacement member 205 and a liquid amount corresponding to the displacement amount of the displacement member 205 are obtained in advance, the remaining amount of liquid in the head tank 35 can be obtained from a detected displacement amount of the displacement member 205.

Hence, for example, when liquid supply to the head tank 35 is controlled by detecting the displacement member 205 of the head tank 35 with the second sensor 301, the controller 500 stops printing operation, moves the carriage 33 to a position at which the second sensor 301 detects the displacement member 205, and perform liquid supply operation.

By contrast, when liquid supply to the head tank 35 is performed during printing operation, as described below, the controller 500 performs liquid supply operation with the first sensor 251 without moving the carriage 33 to the position at which the second sensor 301 detects the displacement member 205.

Next, an example of relationship between negative pressure and liquid amount in the head tank 35 is described with reference to FIG. 11.

Figure 11:
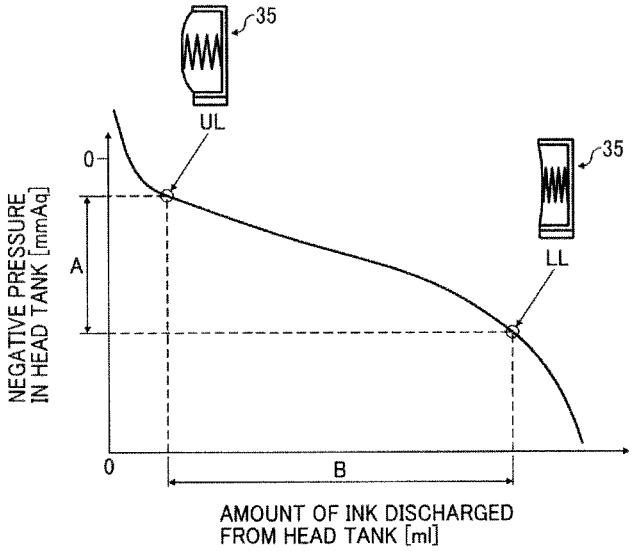
FIG. 11 is a chart of an example of relationship between negative pressure and liquid amount in the head tank.

FIG. 11 shows an example of relationship between negative pressure and liquid amount (hereinafter, also referred to as "ink amount") in the head tank 35.

As described above, while ink is supplied to the head tank 35, ink is discharged from the nozzles of the head tank 35 by sucking operation or fed in reverse from the head tank 35 to the main tank 10 by the liquid feed pump 241. As a result, the film member 203 is pulled inward of the head tank 35 against the restoring force of the spring 204, thus compressing the spring 204 and increasing the negative pressure in the head tank 35. From this state, when ink is supplied to the head tank 35, the film member 203 is pushed outward, thus expanding the spring 204 and reducing the negative pressure in the head tank 35.

Here, if the negative pressure in the head tank 35 is too weak (low), ink might leak from the nozzles of the recording head 34. By contrast, if the negative pressure in the head tank 35 is too strong (high), air or dust might be sucked from the nozzles to the inside of the head tank 35, thus causing ejection failure. In addition, to maintain a meniscus form suitable for desirable droplet ejection, the negative pressure (pressure) in the head tank 35 need be controlled within a certain range.

In other words, as illustrated in FIG. 11, the negative pressure in the head tank 35 correlates with the amount of ink in the head tank 35. The greater the amount of ink in the head tank 35, the smaller (weaker) the negative pressure in the head tank 35. The smaller the amount of ink in the head tank 35, the greater (stronger) the negative pressure in the head tank 35.

Hence, in this exemplary embodiment, as illustrated in FIG. 11, the controller 500 controls ink supply to the head tank 35 so that the amount of ink discharged from the head tank 35 is maintained within a range B (discharged ink amount range B) in which the negative pressure in the head tank 35 is maintained within a range A (negative-pressure control range A).

The amount of ink discharged from the head tank 35 corresponding to a minimum value (relatively small values of negative pressure and discharged ink amount) of the negative-pressure control range A is defined as "ink supply upper limit position UL" with respect to the displacement position of the displacement member 205 ("ink supply upper limit value" regarding the amount of ink). By contrast, the amount of ink discharged from the head tank 35 corresponding to a maximum value (relatively large values of negative pressure and discharged ink amount) of the negative-pressure control range A is defined as "ink consumption lower limit position LL" with respect to the displacement position of the displacement member 205 ("ink consumption lower limit value" regarding the amount of ink). FIG. 10 shows respective states of the head tank 35 at the ink supply upper limit position UL and the ink consumption lower limit position LL.

Next, the setting position of the ink supply upper limit of the head tank 35 is described with reference to FIG. 12.

Figure 12:
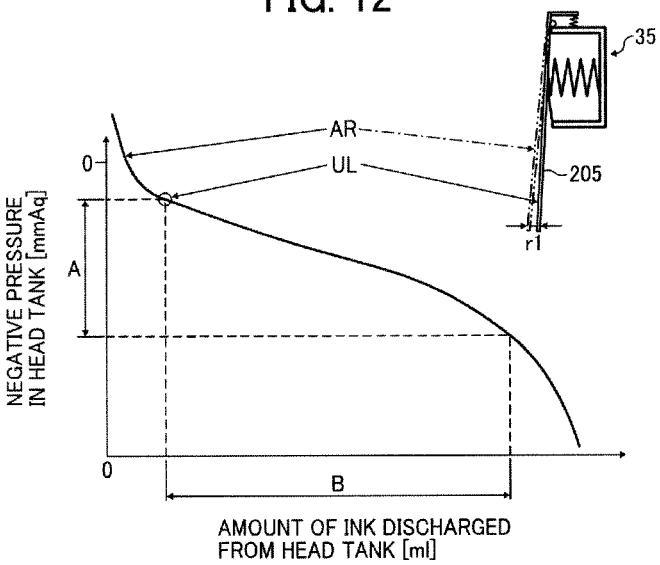
FIG. 12 is a chart of a setting position of an ink supply upper limit in the head tank.

FIG. 12 shows an example of the setting position of the ink supply upper limit of the head tank 35.

In this exemplary embodiment, the head tank 35 has the air release unit (air release valve) 207. When the air release unit 207 opens, air flows into the head tank 35, thus displacing the film member 203 to a position at which the film 203 is fully stretched out. As a result, the displacement member 205 displaces to an air release position AR, which is used as a reference position of the displacement member 205. In this exemplary embodiment, the ink supply upper limit value (ink supply upper limit position UL) is defined as a position to which the displacement member 205 displaces from the air release position AR by a certain displacement amount r1 in a direction in which the remaining amount of liquid in the head tank 35 decreases.

As described above, for the air release position AR or the ink supply upper limit position UL, the linear encoder 90 detects and stores a position of the displacement member 205 detected with the second sensor 301 as a position of the carriage 33.

Next, an example of relationship between ambient environment of the image forming apparatus and the displacement amount of the displacement member 205 in this exemplary embodiment is described with reference to FIG. 13.

Figure 13:
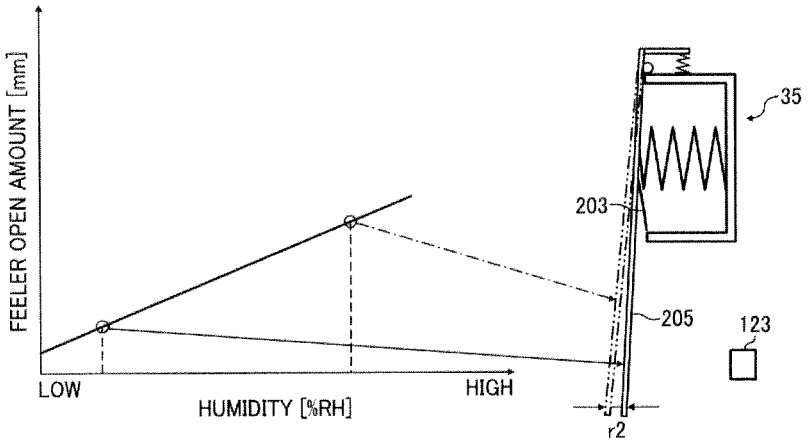
FIG. 13 is a chart of an example of relationship between ambient environment of the image forming apparatus and displacement amount of the displacement member.

FIG. 13 shows an example of the relationship between ambient environment of the image forming apparatus and the displacement amount of the displacement member 205. In FIG. 13, the displacement member 205 is referred to as "feeler".

Changes in the environment include, e.g., changes in humidity, temperature, and atmospheric pressure. For example, in a case in which the film member 203 expands or contracts with changes in humidity, when the air release unit 207 opens the interior of the head tank 35 to the atmosphere, the internal pressure of the head tank 35 turns to an atmospheric pressure, thus displacing the displacement member 205 to a position. The displaced position of the displacement member 205 varies with humidity of the environment.

For example, as illustrated in FIG. 13, in high humidity, the film member 203 expands and the displacement member 205 displaces to a position more distal to the head tank 35 than in low humidity (in a direction in which the remaining amount of liquid in the head tank 35 increases). By contrast, in low humidity, the film member 203 contracts and the displacement member 205 displaces to a position more proximal to the head tank 35 than in high humidity (in a direction in which the remaining amount of liquid in the head tank 35 decreases). In FIG. 13, the displacement amount of the displacement member 205 is referred to as r2.

As described above, since the reference position of the displacement member 205 is the air release position, the ink supply upper limit position varies with changes of the air release position.

Hence, an environment detection sensor 123 is provided to detect changes in the ambient environment. When the environment detection sensor 123 detects an environmental change that causes expansion or contraction of the film member 203 and changes the internal pressure of the head tank 35 and the position of the displacement member 205, the air release unit 207 opens again and the encoder 90 measures and stores the air release position (reference position) and ink supply upper limit position changed with the environmental change again.

Such a configuration allows control of the negative pressure and ink amount in the head tank 35 in response to the ambient environment of the image forming apparatus.

Next, a method of filling ink to an ink full position of the head tank 35 in air release state is described with reference to FIGS. 14A to 14C.

Figure 14A:
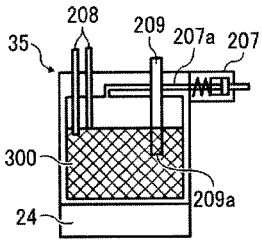
FIGS. 14A to 14C are schematic views of a method of setting the amount of ink in the head tank to an ink full position when the interior of the head tank is opened to the atmosphere.
Figure 14B:
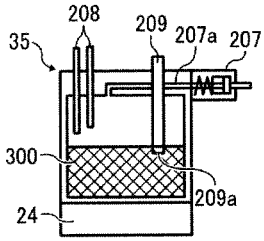
Figure 14C:
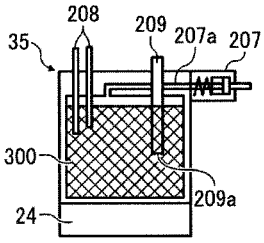

FIGS. 14A, 14B, and 14C show an example of the method of filling ink to an ink full position of the head tank 35.

As described above, the head tank 35 has the electrode pins 208 to detect the liquid level in the head tank 35, the air release passage 207*a* to communicate the interior of the head tank 35 with the atmosphere, and the air release unit 207 to open and close the air release passage 207*a*.

As one example of setting the interior of the head tank 35 to the ink full position, from a state illustrated in FIG. 14A, the air release unit 207 opens to release the negative pressure in the head tank 35, thus lowering the liquid level in the head tank 35 as illustrated in FIG. 14B.

At this time, the supply port 209*a* of the supply port portion 209 is preferably located below the liquid level. It is because, if the supply port 209*a* is above the liquid level, air would flow into the supply tubes 36 via the supply port 209*a* or the supply port portion 209. In such a case, if ink is subsequently supplied, ink might be discharged with bubbles from the supply port 209*a*. Furthermore, if ink is continuously be supplied, bubbles might adhere the interior of the air release unit 207, thus causing fixing of the valve body or ink leakage.

After the negative pressure in the head tank 35 is released and the liquid level falls, as illustrated in FIG. 14C, ink 300 is supplied. Supply of ink 300 raises the liquid level and is continued until the electrode pins 208*a* and 208*b* detect the liquid level at a certain height, i.e., the liquid level reaches a certain position.

Then, the air release unit 207 closes and, for example, a certain amount of ink is discharged from nozzles or fed in reverse from the head tank 35 to the main tank 10 to turn the internal pressure of the head tank 35 into a certain negative pressure value. Thus, the amount of ink in the head tank 35 is set to be an amount to obtain the certain negative pressure value.

Next, ink supply control according to a first exemplary embodiment of this disclosure is described with reference to FIG. 15.

Figure 15:
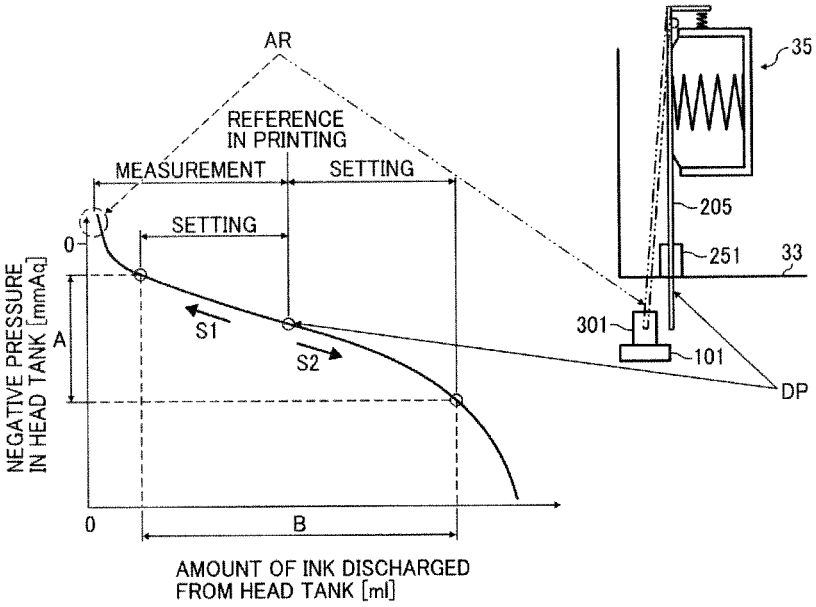
FIG. 15 is a chart of ink supply control in a first exemplary embodiment of this disclosure.

FIG. 15 shows an example of ink supply control. In this exemplary embodiment, ink supply control during printing is performed by detecting a displacement amount (feeler displacement amount) of the displacement member 205 which is a difference between a detected position DP (referred to as "first position") at which the displacement member 205 is detected with the first sensor 251 on the carriage 33 and an air release position AR (referred to as "second position") at which the displacement member 205 is detected with the second sensor 301 on the base member 101 of the apparatus body 1 and controlling the position of the displacement member 205 within a range between an ink supply upper limit position (upper limit value) and an ink consumption lower limit position (lower limit value) set based on the detected position (first position) DP of the displacement member 205 detected with the first sensor 251.

As described above, when ink supply control is performed during printing, the controller 500 changes the reference position of the displacement member 205 from the air release position AR, which is the original reference position, to the detected position DP with the first sensor 251 on the carriage 33, repeats consumption and supply of ink within the range between the ink supply upper limit position and the ink consumption lower limit position set based on the detected position DP of the displacement member 205 with the first sensor 251.

Among products, the image forming apparatus may have different types of variations in, e.g., the setting position of the first sensor 251 on the carriage 33, the dimension of components of the head tank 35, the expanding and contracting displacement of the film member 203 due to influences of humidity environment. Therefore, it is preferable to manage ink supply control so as to be suitable for the conditions of the respective products.

Hence, in this exemplary embodiment, preliminary settings are performed to set values on various control parameters. The preliminary settings are described with reference to FIGS. 16A to 19.

First, since the detected position (first position) DP of the displacement member 205 detected with the first sensor 251 on the carriage 33 is used as the reference position in the ink supply control during printing, the displacement distance L [mm] of the displacement member 205 from the air release position AR, which is the original reference position, to the detected position DP of the displacement member 205 detected with the first sensor 251 on the carriage 33 is measured as a first preliminary setting.

Figure 16A:
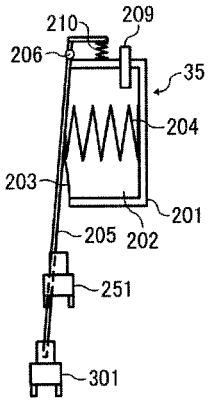
FIGS. 16A to 16C are schematic views of measurement of a displacement distance L as preliminary settings for setting control parameter values in the first exemplary embodiment.
Figure 16B:
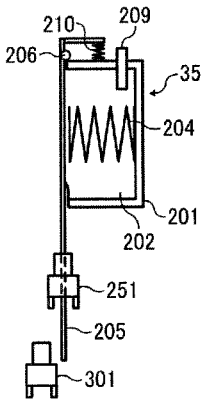

For example, as illustrated in FIG. 16A, the carriage 33 is moved to a position at which the second sensor 301 at the apparatus body 1 can detect the displacement member 205. Then, as illustrated in FIG. 16B, from a state in which the displacement member 205 is placed at the air release position, the liquid feed pump 241 is driven for reverse rotation to feed ink in reverse from the head tank 35 to the main tank 10. Thus, ink is discharged from the head tank 35 until the first sensor 251 on the carriage 33 detects the displacement member 205, and the reverse feed operation stops.

Figure 16C:
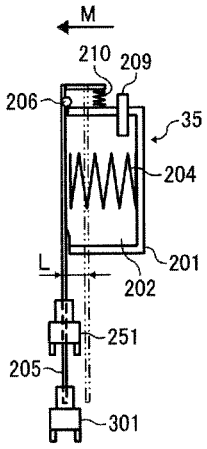

Then, as illustrated in FIG. 16C, in a state in which the first sensor 251 on the carriage 33 detects the displacement member 205, the carriage 33 is moved in a direction indicated by an arrow M until the second sensor 301 on the apparatus body 1 detects the displacement member 205. In this process, the linear encoder 90 measures the movement distance of the carriage 33 to determine a displacement distance (differential displacement amount) L [mm] of the displacement member 205 from the air release position to the position at which the first sensor 251 on the carriage 33 detects the displacement member 205.

Figure 17:
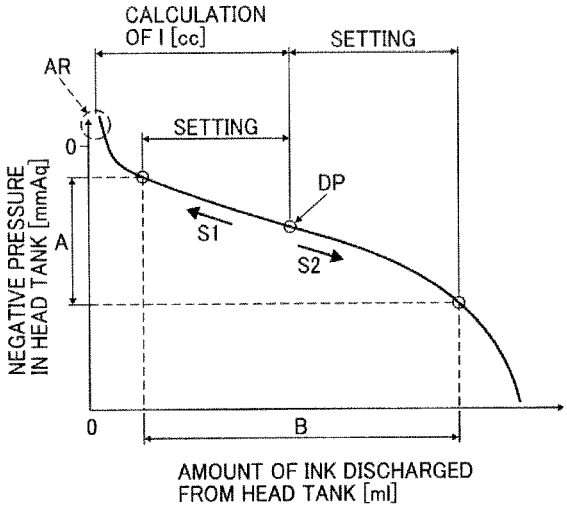
FIG. 17 is a chart of calculation of displacement ink amount 1 in the first exemplary embodiment.

As illustrated in FIG. 17, based on the measured displacement distance L [mm], the displacement ink amount 1 [cc] per displacement distance L [mm] is calculated from an ink amount conversion factor Rmax [cc/mm] relative to displacement distance L [mm], which is determined in consideration of correlation between the amount of ink discharged from the head tank 35 and the displacement amount of the displacement member 205. In FIG. 17, an arrow S1 represents a direction (ink supply direction) in which ink is supplied and an arrow S2 represents a direction (ink consumption direction) in which ink is consumed, which is the same in drawings described below.

FIG. 17 shows negative pressure of calculated displacement ink amount 1 [cc], the amount of ink discharged from the head tank 35, and the displacement ink amount 1 [cc]. The displacement ink amount 1 is calculated from the following equation 1:

$$1\ [\mathrm{cc}]=L\ [\mathrm{mm}]\times R\mathrm{max}\ [\mathrm{cc/mm}].$$

The ink amount conversion factor Rmax [cc/mm] is a conversion factor determined so that the discharged amount of ink relative to the displacement amount of the displacement member 205 takes a maximum value.

Next, an ink amount W [cc] consumed from detection of the displacement member 205 with the first sensor 251 to the ink consumption lower limit position is set as a second preliminary setting.

For example, when ink in the head tank 35 is consumed by printing, the displacement member 205 displaces in a direction in which the remaining amount of liquid (ink) in the head tank 35 decreases. At this time, when the amount of liquid droplets (liquid consumption amount) ejected from the nozzles of the recording head 34 is counted by soft counting from a time point at which the first sensor 251 on the carriage 33 detects the displacement member 205, the ink amount W [cc] consumed (discharged) until detection of the ink consumption lower limit position (value) is set. The controller 500 counts, by soft counting, the number of droplets for each of different droplet amounts of liquid droplets ejected and calculates a sum of droplet amounts for respective droplets sizes, each obtained by multiplying each droplet amount by the counted number of droplets to determine the liquid consumption amount.

Figure 18:
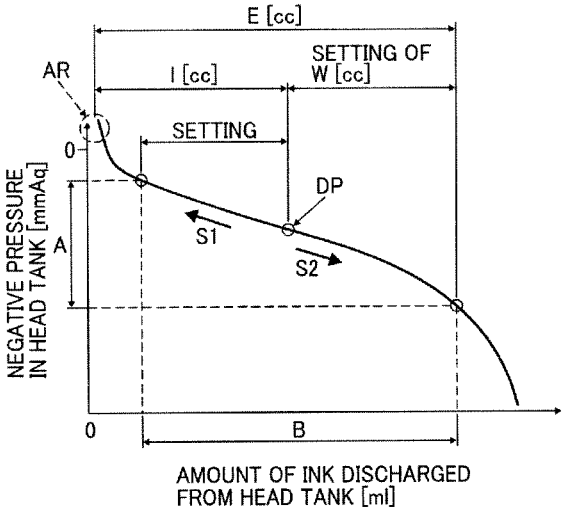
FIG. 18 is a chart of setting of ink amount W in the first exemplary embodiment.

FIG. 18 shows an example of the second preliminary setting.

As the setting of the ink amount W [cc], when the ink amount between the air release position and the ink consumption lower limit position is a maximum discharged ink amount E [cc], the ink amount W [cc] is obtained by subtracting the displacement ink amount 1 [cc] calculated in the first preliminary setting from the maximum discharged ink amount E [cc].

For example, the ink amount W [cc] is set to be a soft count amount at which the remaining amount of ink in the head tank 35 does not fall below the ink consumption lower limit position (value) even in consideration of maximum variations in, e.g., variations in the setting position of the first sensor 251 on the carriage 33, detection errors of the sensors, and fluctuations in the swinging of the displacement member 205 during printing operation, and a maximum variation (100+Smax) [%] of the soft count amount. The ink amount W [cc] is calculated by the following equation 2:

$$W\ [\mathrm{cc}]=(E\ [\mathrm{cc}]-1\ [\mathrm{cc}]-\Delta 2\ [\mathrm{mm}](\text{variation amount})\times R\mathrm{max}\ [\mathrm{cc/mm}])/((100+S\mathrm{max})[\%]/100).$$

Figure 19:
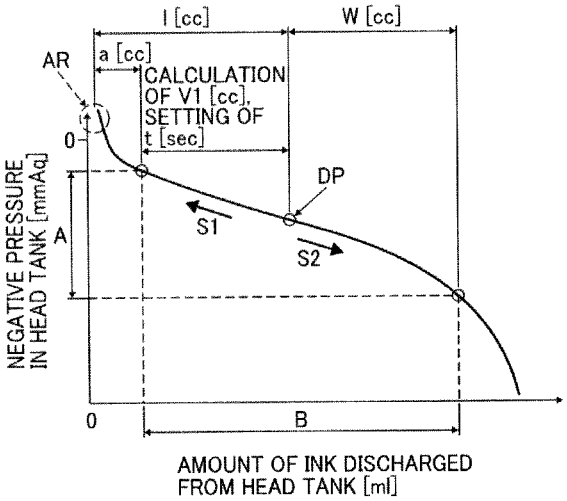
FIG. 19 is a chart of setting of driving time t in the first exemplary embodiment.

FIG. 19 shows a third preliminary setting. In this exemplary embodiment, when the ink consumption lower limit value is detected by soft counting during printing, the liquid feed pump 241 is driven to supply ink from the main tank 10 to the head tank 35. At this time, a driving time t [sec] of the liquid feed pump 241 from a time point at which the first sensor 251 on the carriage 33 detects the displacement member 205 is set.

An ink amount V1 [cc] is obtained by subtracting both an ink amount "a" [cc] for forming negative pressure, which is the ink supply upper limit value calculated from the air release position AR, and a variation amount including detection errors of the first sensor 251 on the carriage 33 and the second sensor 301 from the displacement ink amount 1 [cc] previously calculated in the first preliminary setting.

Hence, the driving time t [sec] of the liquid feed pump 241 after the detection of the displacement member 205 with the first sensor 251 on the carriage 33 is set to be a time in which the liquid feed pump 241 supplies the ink amount V1 [cc] at a maximum ink supply flow amount Qmax [cc/sec].

The driving time t [sec] is set to be a time in which the amount of ink in the head tank 35 does not go beyond the ink supply upper limit value even in consideration of influences of various variations, e.g., variations in the liquid feed flow amount of the liquid feed pump 241, delay in software control, detection errors of the first sensor 251 on the carriage 33, and fluctuations in the swing of the displacement member 205. The ink amount V1 [cc] is calculated from the following equation 3:

V1 [cc]=1 [cc]−a [cc]−(Δ1 [mm](variation amount)×Rmin [cc/mm]), and the driving time t [sec] is calculated from the following equation 4:

$$t\ [\mathrm{sec}]=V1\ [\mathrm{cc}]/Q\mathrm{max}\ [\mathrm{cc/sec}].$$

The ink amount "a" [cc] for negative pressure formation may be an ink amount converted from a certain distance from the air release position AR. In other words, the second position may be obtained by subtracting the certain distance from the air release position.

Figure 20:
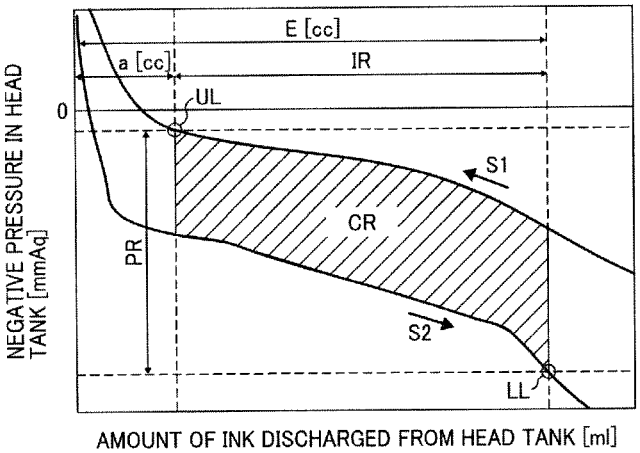
FIG. 20 is a chart of actual control range CR in the first exemplary embodiment.

The above-described preliminary settings are performed in consideration of the negative pressure characteristics of the head tank 35 as well as mechanical variations, optical direction variations, and control variations. Since the head tank 35 has negative pressure characteristics with hysteresis due to temperature and humidity environment and ink discharge and supply of the head tank 35, as illustrated in FIG. 20, the amount of ink in the head tank 35 is constantly controlled within a control range CR set in consideration of the hysteresis. In FIG. 20, the control range CR is defined by an ink use range IR, an upper limit value UL and a lower limit value LL of the ink amount in the head tank 35, and a pressure use range PR.

Next, ink consumption during printing operation and basic operation of supply control are described with reference to FIG. 21.

Figure 21:
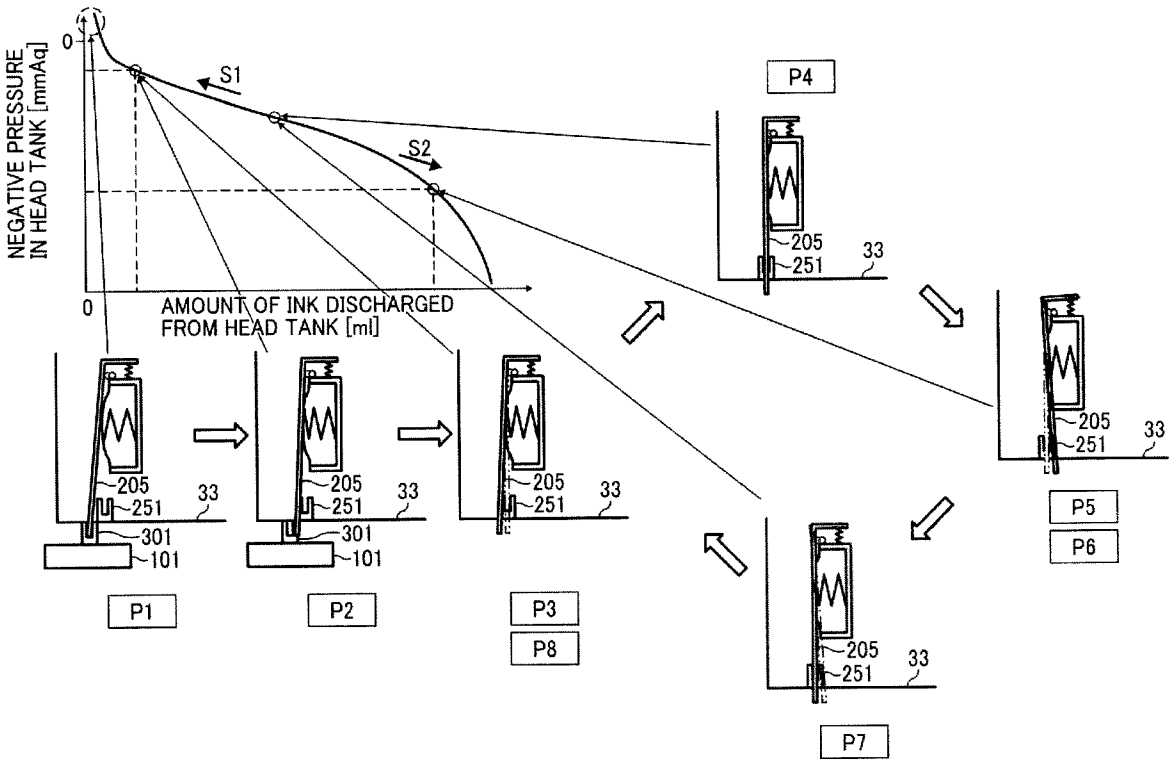
FIG. 21 is a chart of a state shift from an air release state of the head tank to a driving-stop state of the liquid feed pump during printing operation in the first exemplary embodiment.

FIG. 21 shows an example of the state shift from an air release state P1 of the head tank to a driving-stop state P8 of the liquid feed pump.

In the air release state P1 and an ink supply upper limit state P2 in which negative pressure is formed in the head tank, the measurement and control value setting of the preliminary settings for ink supply control during printing are performed and the carriage stands by at the ink supply upper limit value.

When printing is performed, the displacement member 205 displaces with ink consumption from the ink supply upper limit state P2 (state P3). When ink is consumed until the first sensor 251 on the carriage 33 detects the displacement member 205, soft counting of the consumption amount of ink starts (state P4).

When the soft counting of the consumption amount of ink detects that ink is consumed up to the ink consumption lower limit value by the ink amount W [cc] (state P5), the liquid feed pump 241 starts driving to supply ink from the main tank 10 to the head tank 35 (state P6).

When ink is supplied, the displacement member 205 of the head tank 35 displaces to the position at which the first sensor 251 on the carriage 33 detects the displacement member 205 again and counting of the driving time of the liquid feed pump 241 starts (state P7).

After the liquid feed pump 241 is additionally driven for the driving time t [sec] to continue ink supply, the liquid feed pump 241 stops driving (state P8) and the head tank 35 returns to the initial state P3 at the start of printing.

Such a series of ink consumption and ink supply control operation is performed because, on detection of the displacement member 205 with the first sensor 251 on the carriage 33, accumulated detection errors including, e.g., soft count errors and errors in the supply amount of ink of the liquid feed pump 241 can be canceled.

In addition, using two sensors, i.e., the first sensor 251 on the carriage 33 and the second sensor 301 on the apparatus body 1 allows control setting suitable for variations in dimensional precision of components of respective products and ambient environment.

Figure 22:
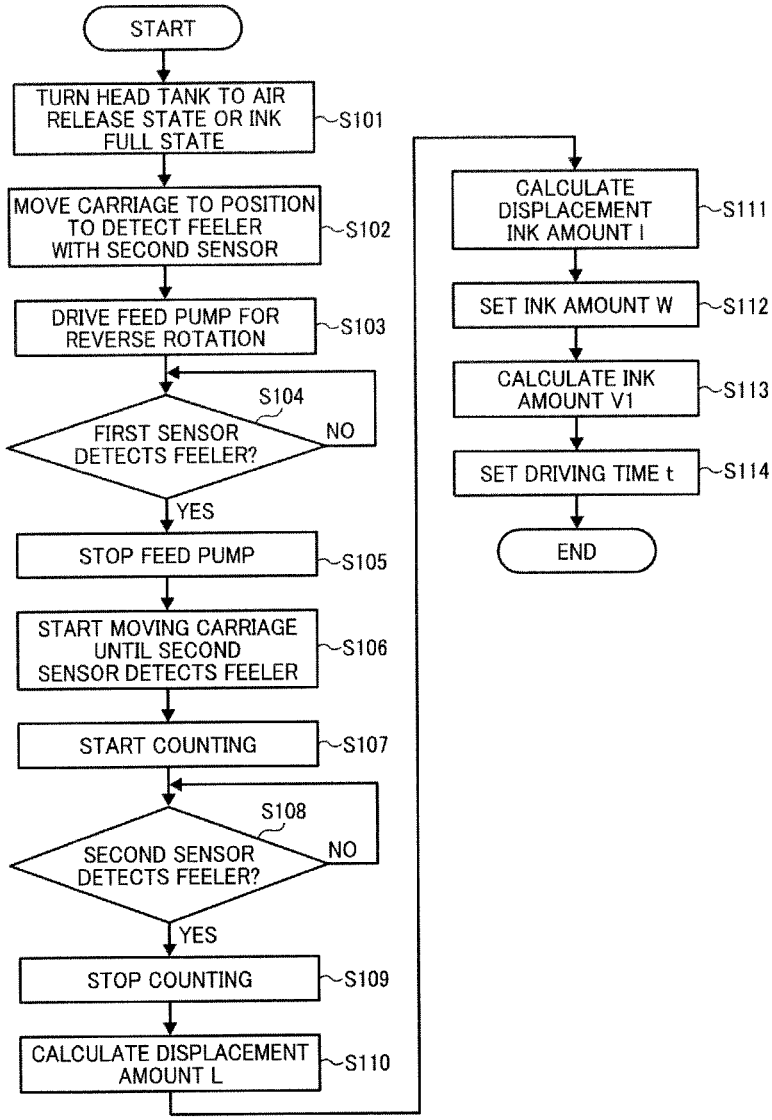
FIG. 22 is a flowchart of a procedure of preliminary settings performed by the controller in the first exemplary embodiment.

Next, the above-described preliminary settings performed by the controller in this exemplary embodiment are further described with reference to FIG. 22.

At S101, the controller turns the head tank 35 into the air release state or ink full state. At S102, the controller moves the carriage 33 to the second position at which the second sensor 301 detects the displacement member 205 (feeler).

At S103, the controller drives the liquid feed pump 241 for reverse rotation to suck ink until the first sensor 251 detects the displacement member 205. When the first sensor 251 detects the displacement member 205 (YES at S104), at S105 the controller stops the reverse rotation of the liquid feed pump 241.

At 106, the controller starts moving the carriage 33 to the second position at which the second sensor 301 detects the displacement member 205. At S107, the linear encoder 90 starts counting. When the second sensor 301 detects the displacement member 205 (YES at S108), at S109 the linear encoder 90 stops counting.

At S110, the displacement amount (displacement distance) L of the displacement member 205 is calculated between the air release position (second position of the carriage 33) and the first position at which the first sensor 251 detects the displacement member 205.

At S111, as described above, the displacement ink amount 1 is calculated from the displacement amount L and the ink amount conversion factor Rmax. At S112, the ink amount W is set, and at S113 the ink amount V1 is calculated. At S114, the driving time t of the liquid feed pump 241 corresponding to a differential supply amount in supplying ink without using the second sensor 301 is set.

As described above, in this exemplary embodiment, the air release position of the displacement member 205 corresponds to the second position of the carriage 33. Alternatively, the ink full position may correspond to the second position, and a supply amount corresponding to a displacement amount between the second position and the first position may be stored as the differential supply amount. It depends on how to determine the ink full position.

Figure 23:
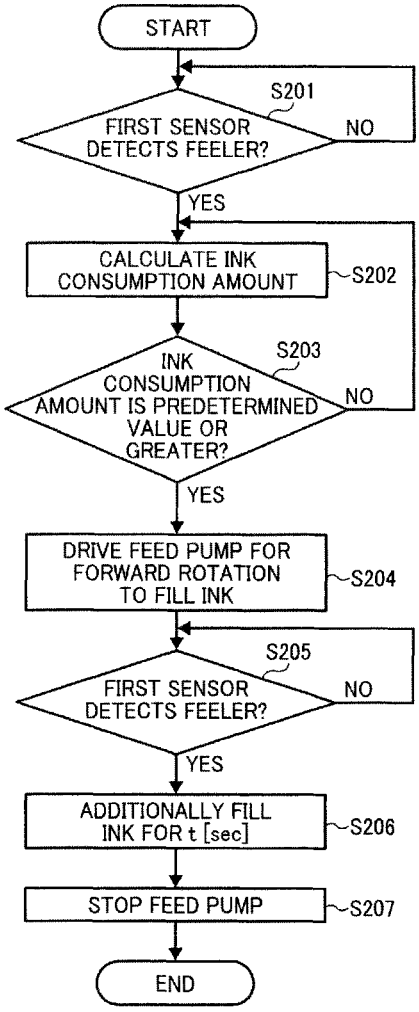
FIG. 23 is a flowchart of a procedure of ink filling control (supply control) performed by the controller without using a second sensor in the first exemplary embodiment of the present disclosure.

Next, a procedure of ink filling control (supply control) performed by the controller without using the second sensor in the first exemplary embodiment of the present disclosure is described with reference to FIG. 23.

During printing operation, as ink of the head tank 35 is consumed from the ink full state, the displacement member 205 shifts in a direction in which the remaining amount of ink (liquid remaining amount) in the head tank 35 decreases. At S201, the controller determines whether or not the first sensor 251 detects the displacement member 205.

When the displacement member 205 shifts in the direction in which the remaining amount of ink (liquid remaining amount) in the head tank 35 decreases and the first sensor 251 detects the displacement member 205 (YES at S201), at S202 the controller starts to measure the consumption amount of ink by soft counting and at S203 determines whether or not the consumption amount of ink is a predetermined liquid consumption amount (predetermined amount, i.e., the ink amount W [cc] consumed up to the ink consumption lower limit value) or greater.

When the ink consumption amount becomes the predetermined liquid consumption amount or greater (YES at S203), the controller drives the liquid feed pump for forward rotation and starts to fill (supply) ink to the head tank 35.

At S205, the controller determines whether or not the first sensor 251 detects the displacement member 205 of the head tank 35. When the first sensor 251 detects the displacement member 205 of the head tank 35 (YES at S205), at S206 the controller continues driving of the liquid feed pump 241 for the driving time t to fill ink to the head tank 35 by the differential supply amount. At S207, the controller stops driving of the liquid feed pump 241 and resets a calculation value of the consumption amount of ink.

Thus, even during printing operation, ink can be filled to the head tank 35 without returning the carriage 33 to the home position.

Next, a procedure of feeler position control performed by the controller in a non-printing period, e.g., after printing operation in the first exemplary embodiment is described with reference to FIG. 24.

In this exemplary embodiment, after printing operation ends and when soft counting is performed to measure the consumption amount of ink after detection of the displacement member 205 with the first sensor 251 on the carriage 33, the controller continues ink supply until the displacement member (feeler) 205 arrives at the detected position with the first sensor 251 (first position) or a position at which the amount of ink in the head tank 35 (liquid remaining amount) is greater than when the displacement member 205 is at the first position. Thus, the position of the displacement member 205 (feeler position) is controlled to be the detected position (first position) with the first sensor 251 or the position at which the amount of ink in the head tank 35 (liquid remaining amount) is greater than when the displacement member 205 is at the first position.

If, after one printing operation ends, the next printing operation is not performed for a long time, changes in the permeability of ink supply passage and channel connecting portions and the ambient environment may change the internal pressure of the ink passage, thus changing the position of the displacement member 205. As a result, an error may arise between the position of the displacement member 205 corresponding to the consumption amount of ink measured by soft counting and the actual position of the displacement member 205.

In such a case, if the next printing operation is performed and ink is consumed up to the ink consumption lower limit value by the ink amount W [cc], the internal pressure of the head tank 35 may turn into an excessive negative pressure, thus causing degraded print quality due to ink ejection failure or nozzle down state (non-ejectable state) due to air introduced from nozzle orifices.

Figure 24:
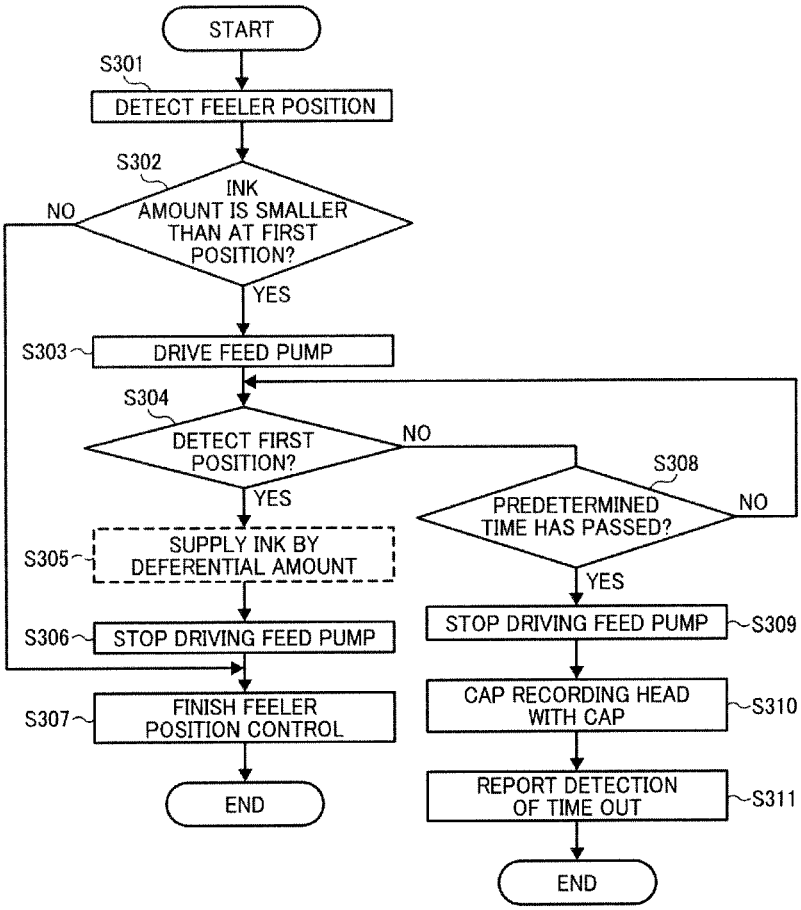
FIG. 24 is a flowchart of a procedure of feeler position control performed after printing operation.

Hence, in FIG. 24, after printing operation, at S301 the controller detects the position of the displacement member 205 and at S302 determines whether or not the displacement member 205 is at a position at which the amount of ink in the head tank 35 is smaller than when the displacement member 205 is at the first position, i.e., the position at which the displacement member 205 is detected with the first sensor 251 on the carriage 33.

When the displacement member 205 is at the position at which the amount of ink in the head tank 35 is smaller than when the displacement member 205 is at the first position (YES at S302), at S303 the controller drives the liquid feed pump 241 to supply ink to the head tank 35 and at S304 determines whether or not the first sensor 251 detects the displacement member 205.

When the first sensor 251 detects the displacement member 205 (YES at S304), at S306 the controller stops driving of the liquid feed pump 241 and at S307 finishes the feeler position control.

In such a case, as illustrated by a broken line, after the first sensor 251 detects the displacement member 205 (YES at S304), at S305 the controller may further supply ink by an additional amount, e.g., the differential ink amount additionally filled for the driving time t of the liquid feed pump 241 after the detection of the first sensor 251, and at S306 may stop driving of the liquid feed pump 241.

By contrast, when the first sensor 251 does not detect the displacement member 205 for a predetermined time (NO at S304 ad YES at S308), at S309 the controller stops driving of the liquid feed pump 241. At S310 the controller causes the cap 82 to cap the recording head 34 and at S311 reports an error (time out detection error). The error report can be performed via, e.g., the operation panel of the image forming apparatus or the printer driver of the host.

Regarding the detection of the position of the displacement member 205 after printing operation, for example, when printing operation ends, the controller determines whether or not soft counting of the consumption amount of ink is being performed after detection of the displacement member 205 with the first sensor 251 on the carriage 33. When the soft counting is being performed, the controller can determine that the displacement member 205 is at a side (position) at which the amount of ink in the head tank 35 is smaller than when the displacement member 205 is at the detected position at which the displacement member 205 is detected with the first sensor 251 on the carriage 33.

Alternatively, regarding the detection of the position of the displacement member 205 after printing operation, for example, after printing operation ends, the controller may determine the position of the displacement member 205 by moving the carriage 33 for scanning and comparing a position of the carriage obtained when the displacement member 205 is detected with the second sensor 301 on the apparatus body 1 with another position of the carriage detected with the second sensor 301 on the apparatus body 1 when the displacement member 205 is detected with the first sensor 251 on the carriage 33, which is measured and stored in advance in the first preliminary setting.

Thus, after printing operation ends, the position of the displacement member can be set to be at a side at which the remaining amount of liquid in the head tank 35 is greater than when the displacement member is at the first position. When the next printing operation starts, such a configuration can prevent the internal pressure of the head tank 35 from turning into an excessive negative pressure, thus preventing degraded print quality due to ink ejection failure or nozzle down state (non-ejectable state) due to air introduced from nozzle orifices.

Next, a second exemplary embodiment of the present disclosure is described below.

In this second exemplary embodiment, after printing operation ends, maintenance and recovery operation (also referred to as "maintenance operation") is performed. Then, as with the above-described first exemplary embodiment, when the displacement member 205 is at a position at which the amount of ink in the head tank 35 is smaller than when the displacement member 205 is at the first position at which the displacement member 205 is detected with the first sensor 251, ink supply (filling) operation is performed.

Next, a third exemplary embodiment of the present disclosure is described below.

In this third exemplary embodiment, as with the above-described first exemplary embodiment, on turning on (starting up) the image forming apparatus, if the displacement member 205 is at a position at which the amount of ink in the head tank 35 is smaller than when the displacement member 205 is at the first position at which the displacement member 205 is detected with the first sensor 251, ink supply (filling) operation is performed.

In other words, as in the case in which, after one printing operation ends, the next printing operation is not performed for a long time, when the image forming apparatus is turned off for a long time, changes in the ambient environment and the permeability of ink supply passage and channel connecting portions may change the internal pressure of ink supply passage, thus changing the position of the displacement member 205. Hence, in this third exemplary embodiment, when the image forming apparatus is turned on, the position of the displacement member 205 is detected and corrected to a proper position.

Next, a fourth exemplary embodiment of the present disclosure is described below.

In this exemplary embodiment, when the image forming apparatus is turned on, the position of the displacement member 205 is detected. When it is detected that the displacement member 205 is at a position at which the amount of ink in the head tank 35 is greater than when the displacement member 205 is at the second position, i.e., the ink full position, the above-described preliminary settings for detecting the differential ink amount are performed again to properly maintain the amount of ink and pressure in the head tank 35.

Next, a fifth exemplary embodiment of the present disclosure is described with reference to FIGS. 25A to 25C.

Figure 25A:
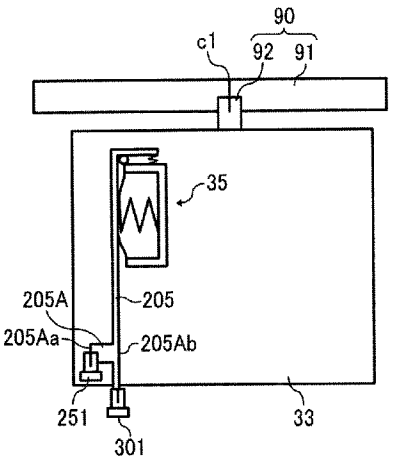
FIGS. 25A to 25C are schematic views of a head tank on a carriage and first and second sensors in a fifth exemplary embodiment of this disclosure.
Figure 25B:
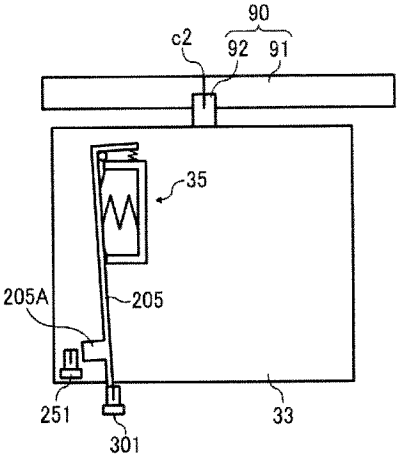
Figure 25C:
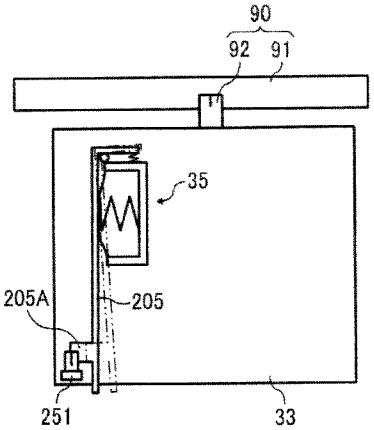

FIGS. 25A to 25C are schematic views of the fifth exemplary embodiment.

In this fifth exemplary embodiment, the displacement member 205 is provided with a detected portion 205A having a certain width in a direction (displacement direction) in which the displacement member 205 displaces. The first position of the displacement member 205 detected with the first sensor 251 is one end 205Aa of the detected portion 205A in the displacement direction of the displacement member 205.

For such a configuration, where "1" represents a detection output of the first sensor 251 obtained when the first sensor 251 detects the detected portion 205A and "0" represents a detection output of the first sensor 251 obtained when the first sensor 251 does not detect the detected portion 205A, the first sensor 251 detects the end 205Aa or an opposite end 205Ab of the detected portion 205A of the displacement member 205, for example, when the detection output of the first sensor 251 shifts as follows.

(1) From a state in which the displacement member 205 is at a side at which the remaining amount of ink in the head tank 35 is relatively large and the opposite end 205Ab of the detected portion 205A is not detected with the first sensor 251, the remaining amount of ink decreases and the detection output of the first sensor 251 shifts from "0" to "1" or further shifts from "1" to "0" after the shift from "0" to "1".

(2) From a state in which the displacement member 205 is at the side at which the remaining amount of ink in the head tank 35 is relatively large and the opposite end 205Ab of the detected portion 205A is detected with the first sensor 251, the remaining amount of ink decreases and the detection output of the first sensor 251 shifts from "1" to "0".

(3) From a state in which the displacement member 205 is at a side at which the remaining amount of ink in the head tank 35 is relatively small and the end 205Aa of the detected portion 205A is not detected with the first sensor 251, the remaining amount of ink increases and the detection output of the first sensor 251 shifts from "0" to "1" or further shifts from "1" to "0" after the shift from "0" to "1".

(4) From a state in which the displacement member 205 is at the side at which the remaining amount of ink in the head tank 35 is relatively small and the detected portion 205A is detected with the first sensor 251, the remaining amount of ink increases and the detection output of the first sensor 251 shifts from "1" to "0".

Next, a procedure of feeler position control performed by the controller after printing operation, maintenance operation, or turning-on (start-up) of the image forming apparatus according to the fifth exemplary embodiment is described with reference to FIGS. 25A to 25C.

First, as illustrated in FIG. 25A, the controller stores a carriage position c1 measured when the second sensor 301 on the apparatus body 1 detects the displacement member 205 with the first position of the displacement member 205 detected by the first sensor 251 on the carriage 33 in the detecting operation of the difference amount.

As illustrated in FIG. 25B, for example, after printing operation ends, the controller moves the carriage 33 for scanning, compares the carriage position c1 with a carriage position c2 obtained when the second sensor 301 on the apparatus body 1 detects the displacement member 205, and determines whether or not the displacement member 205 is at a position at which the amount of ink in the head tank 35 is smaller (or greater) than when the displacement member 205 is at the first position detected with the first sensor 251.

When the displacement member 205 is at a position at which the amount of ink in the head tank 35 is smaller than when the displacement member 205 is at the first position detected with the first sensor 251, as illustrated in FIG. 25C, ink is filled until the first sensor 251 detects the first position of the displacement member 205 or further filled by the differential amount after the detection of the first position.

When the displacement member 205 is at a position at which the amount of ink in the head tank 35 is greater than when the displacement member 205 is at the first position of the displacement member 205 detected with the first sensor 251, the controller may drive the liquid feed pump 241 for reverse rotation to feed ink in the reverse direction until the first sensor 251 detects the first position of the displacement member 205.

Next, a sixth exemplary embodiment of the present disclosure is described with reference to FIGS. 26A to 26C.

Figure 26A:
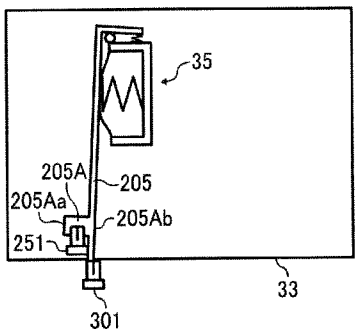
FIGS. 26A to 26C are schematic views of a head tank on a carriage and first and second sensors in a sixth exemplary embodiment of this disclosure.
Figure 26B:
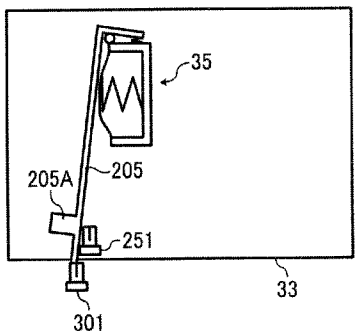
Figure 26C:
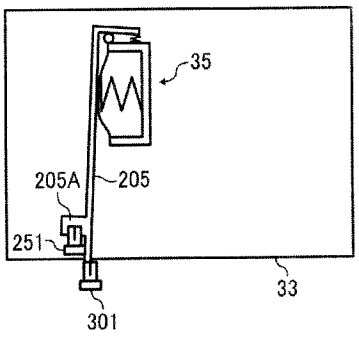

FIGS. 26A to 26C are schematic views of the sixth exemplary embodiment.

In this exemplary embodiment, as with the above-described fifth exemplary embodiment, the first position of the displacement member 205 detected with the first sensor 251 is one end 205Aa of the detected portion 205A in the displacement direction of the displacement member 205.

The first sensor 251 is disposed at such a position that, when the second sensor 301 detects that the displacement member 205 is at the ink full position serving as the second position, as illustrated in FIG. 16A, the first sensor 251 might detect the detected portion 205A of the displacement member 205 depending on the ambient environment (e.g., temperature and/or humidity).

For such a configuration, as illustrated in FIG. 26B, after maintenance operation is performed to clean nozzles of the recording head 34, a predetermined amount of ink might not be properly sucked from the recording head 34 in cleaning operation, thus causing the displacement member 205 to be placed at a position, e.g., the air release position at which the amount of ink in the head tank 35 is greater than when the displacement member 205 is at the second position. Hence, in this sixth exemplary embodiment, after maintenance operation, the position (feeler position) of the displacement member 205 may be controlled as follow.

Below, a first example of the feeler position control after maintenance operation is described with reference to FIG. 27.

Figure 27:
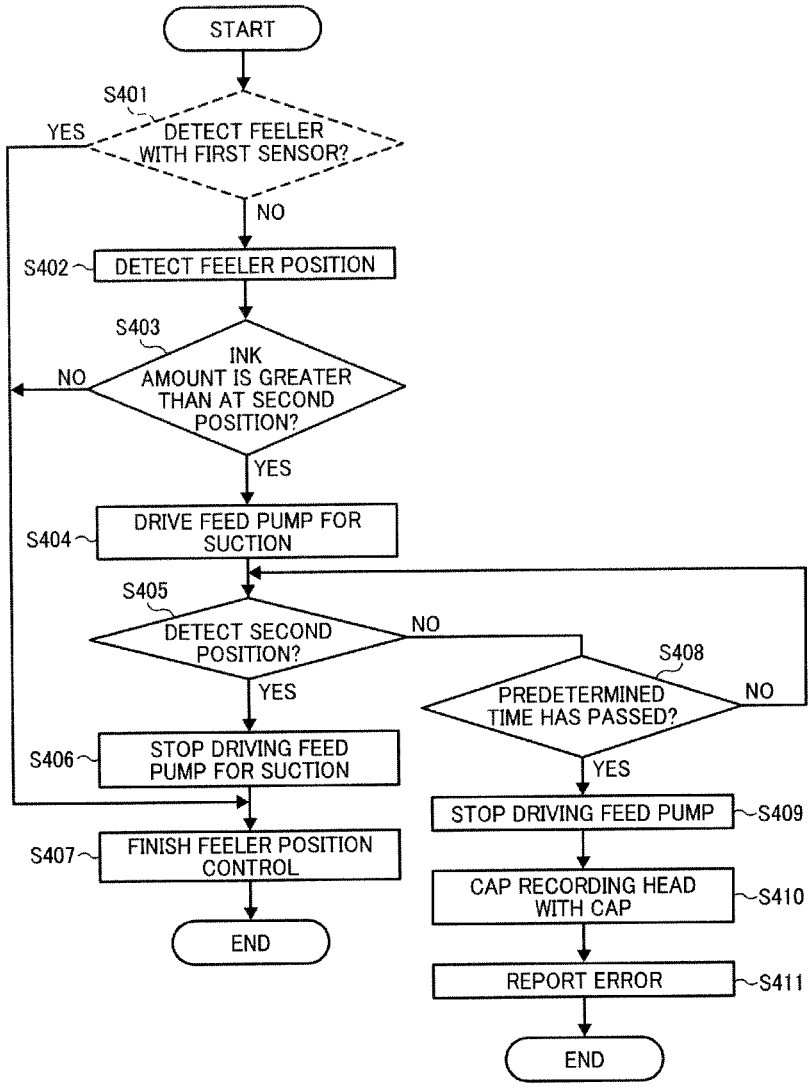
FIG. 27 is a flowchart of a first example of feeler position control performed after maintenance operation in the sixth exemplary embodiment of this disclosure.

As illustrated in FIG. 27, after maintenance operation ends, at S402 the controller detects the position of the displacement member 205 and at S403 determines whether or not the position of the displacement member 205 is a position at which the amount of ink in the head tank 35 is greater than when the displacement member 205 is at the second position. In this process, as indicated by a broken line, at S401, the controller may detect the displacement member 205 with the first sensor 251.

When the displacement member 205 is at a position at which the amount of ink in the head tank 35 is greater than when the displacement member 205 is at the second position (YES at S403), at S404 the controller drives the liquid feed pump 241 for reverse rotation (ink suction) to feed ink in the reverse direction from the head tank 35 to the main tank 10 and at S405 determines whether or not the second sensor 301 detects the displacement member 205 (that the displacement member 205 is at the second position) as illustrated in FIG. 26C.

When the second sensor 301 detects the displacement member 205 (YES at S405), at S406 the controller stops driving of the liquid feed pump 241 and at S407 finishes the feeler position control.

By contrast, when the second sensor 301 does not detect the displacement member 205 at the second position for a predetermined time (NO at S405 ad YES at S408), at S409 the controller stops driving of the liquid feed pump 241. At S410 the controller causes the cap 82 to cap the recording head 34 and at S411 reports an error. The error report can be performed via, e.g., the operation panel of the image forming apparatus or the printer driver of the host.

Next, a second example of the feeler position control after maintenance operation is described with reference to FIG. 28.

Figure 28:
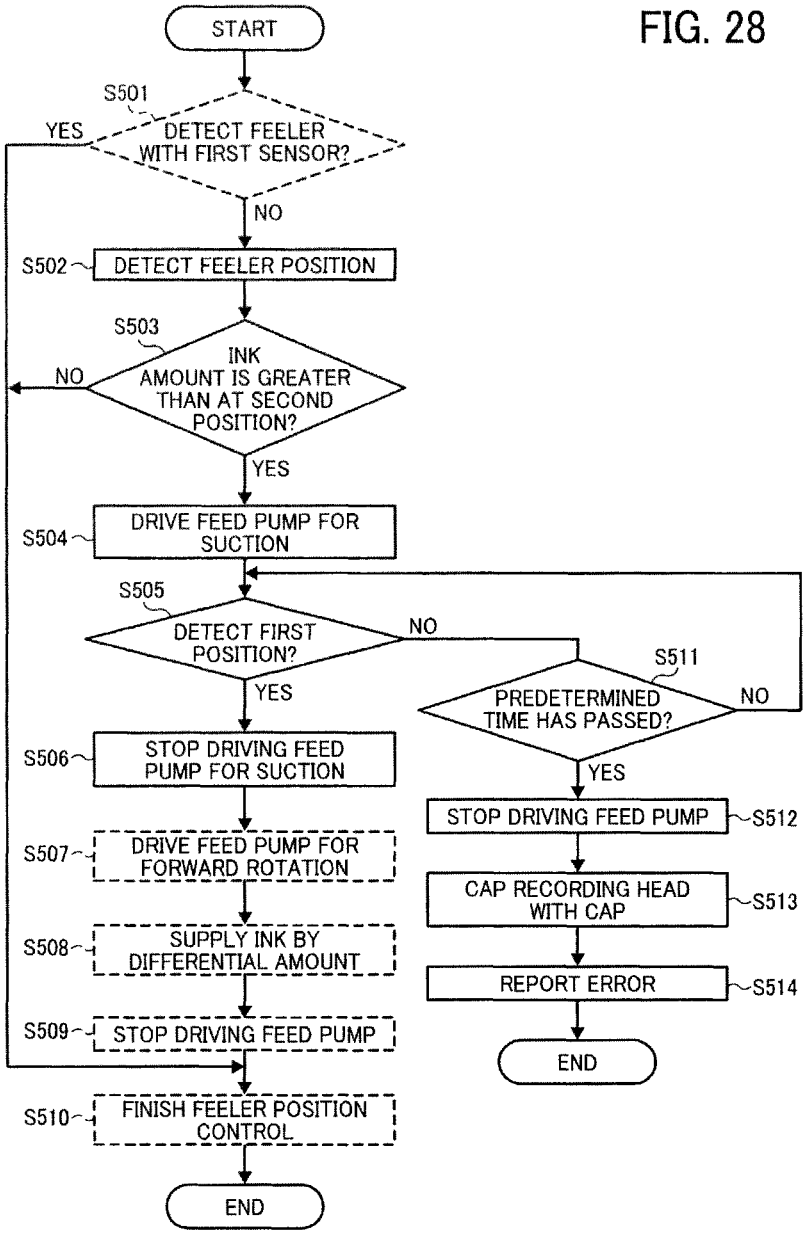
FIG. 28 is a flowchart of a second example of feeler position control performed after maintenance operation in the sixth exemplary embodiment of this disclosure.

As illustrated in FIG. 28, after maintenance operation ends, at S502 the controller detects the position of the displacement member 205 and at S503 determines whether or not the position of the displacement member 205 is a position at which the amount of ink in the head tank 35 is greater than when the displacement member 205 is at the second position. In this process, as indicated by a broken line, at S501, the controller may detect the displacement member 205 with the first sensor 251.

When the displacement member 205 is at a position at which the amount of ink in the head tank 35 is greater than when the displacement member 205 is at the second position (YES at S503), at S504 the controller drives the liquid feed pump 241 for reverse rotation (ink suction) to feed ink in the reverse direction from the head tank 35 to the main tank 10 and at S505 determines whether or not the first sensor 251 detects the end 205Aa of the detected portion 205A of the displacement member 205 (that the displacement member 205 is at the first position).

When the first sensor 251 detects that the displacement member 205 is at the first position (YES at S505), at S506 the controller stops driving of the liquid feed pump 241 and at S510 finishes the feeler position control.

In this process, as indicated by broken lines, after stopping the reverse rotation driving of the liquid feed pump 241 (S506), the controller may drive the liquid feed pump 241 for forward rotation (S507), supply ink from the main tank 10 to the head tank 35 by the difference amount (S508), and stop the forward rotation driving of the liquid feed pump 241 (S509).

By contrast, when the first sensor 251 does not detect the displacement member 205 at the first position for a predetermined time (NO at S505 ad YES at S511), at S512 the controller stops driving of the liquid feed pump 241. At S513 the controller causes the cap 82 to cap the recording head 34 and at S514 reports an error.

In this exemplary embodiment, when the controller controls driving of the liquid feed pump 241 with the first sensor 251 on the carriage 33 without using the second sensor 301. Such a configuration allows the driving of the liquid feed pump 241 to be controlled at any position without being limited by the position of the carriage. In addition, such a configuration can be applied to an image forming apparatus including a plurality of head tanks 35, a plurality of displacement members 205, and a plurality of first sensors 251, thus allowing simultaneous driving control of a plurality of liquid feed pumps 241 relative to the plurality of head tanks 35.

Next, a seventh exemplary embodiment of the present disclosure is described below.

In this exemplary embodiment, as a confirmation process immediately before the start of printing, when the displacement member 205 is at the second position, the controller determines whether or not the first sensor 251 on the carriage 33 detects the detected portion 205A of the displacement member 205. When the first sensor 251 does not detect the detected portion 205A of the displacement member 205, the controller determines the position of the displacement member 205 with the second sensor 301.

When the displacement member 205 is at a position at which the amount of ink in the head tank 35 is greater than when the displacement member 205 is at the second position, as with the above-described sixth exemplary embodiment, the controller drives the liquid feed pump 241 for reverse rotation to feed ink in the reverse direction until the second sensor 301 detects the displacement member 205 (that the displacement member 205 is at the second position).

At this time, as with the second example of the above-described sixth exemplary embodiment, the controller may drive the liquid feed pump 241 for reverse rotation to feed ink in the reverse direction until the first sensor 251 detects the end 205Aa (first position) of the detected portion 205A of the displacement member 205. In such a case, after the reverse rotation driving, the controller may drive the liquid feed pump 241 for forward rotation again to additionally supply ink to the head tank 35 by the differential amount set in the above-described third preliminary setting.

By contrast, when the displacement member 205 is at a position at which the amount of ink in the head tank 35 is smaller than when the displacement member 205 is at the first position, the controller may drive the liquid feed pump 241 for forward rotation to supply ink to the head tank 35 until the first sensor 251 detects the end 205Aa of the detected portion 205A of the displacement member 205 (the first position of the displacement member 205).

At this time, after the ink supply, the controller may continue the forward rotation driving of the liquid feed pump 241 to additionally supply ink to the head tank 35 by the difference amount set in the above-described third preliminary setting.

Even when printing operation is not performed for a long time, such detection and correction of the position of the displacement member 205 can prevent failures, such as degraded print quality, nozzle down, and liquid leakage, thus allowing stable liquid supply compatible with long sheet printing or continuous printing.

After printing or maintenance operation ends or the image forming apparatus is turned on, the above-described feeler position control is performed in advance so that the displacement member 205 is already in a proper state at the start of printing, thus preventing the feeler position control from affecting the printing speed.

For the confirmation of the position of the displacement member 205 immediately before printing operation, the displacement member 205 is detected with the first sensor 251 on the carriage 33. Such a configuration obviates additional operation of the carriage 33, thus minimizing influence to the printing speed.

In the above-described exemplary embodiment, the example is described in which the controller performs the feeler position control after printing operation ends. It is to be noted that, for example, the controller may perform the feeler position control when a predetermined time passes after printing operation ends and may not perform the feeler position control when the next printing operation is started before the predetermined time passes.

In other words, when the next printing operation is started for a relatively short or the position of the displacement member 205 is less likely to change due to changes in the permeability of the ink supply passage and connecting portions and the ambient environment, the controller may perform the next printing operation while continuing the soft counting performed at the end of printing operation without confirming the position of the displacement member 205 after the end of printing operation.

When printing operation is performed on a series of a plurality of recording media, such a configuration can effectively perform the printing operation without excessively performing correcting operation of the position of the displacement member for each interval between printing operations.

During scanning of the carriage, e.g., in printing operation, when a recording medium contacts, e.g., the recording head 34, the displacement member 205, or the first sensor 251 and a paper jam of stopping the scanning of the carriage is detected, the controller performs the above-described preliminary settings for detecting the difference amount again to properly control the amount of ink and pressure in the head tank 35.

When the paper jam of stopping the scanning of the carriage is detected, the controller may confirm the position of the displacement member 205 with the second sensor 301.

At this time, as a result of the confirmation, when the position of the displacement member 205 is at a position at which the amount of ink in the head tank 35 is smaller than when the displacement member 205 is at the first position, as with the above-described first to seventh exemplary embodiments, the controller performs ink supply (filling) operation. By contrast, when the position of the displacement member 205 is at a position at which the amount of ink in the head tank 35 is greater than the second position, as with the above-described first to seventh exemplary embodiments, the controller drives the liquid feed pump 241 for reverse rotation to feed ink in the reverse direction from the head tank 35 to the main tank 10.

Numerous additional modifications and variations are possible in light of the above teachings. It is therefore to be understood that, within the scope of the appended claims, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. An image forming apparatus comprising:

an apparatus body;

a recording head to eject liquid droplets;

a head tank to store liquid to be supplied to the recording head;

a carriage mounting the recording head and the head tank;

a main tank to store the liquid to be supplied to the head tank;

a liquid feed device to supply the liquid from the main tank to the head tank;

a supply controller to control driving of the liquid feed device to supply the liquid from the main tank to the head tank;

a displacement member provided at the head tank and displaceable with a remaining amount of the liquid in the head tank;

a first detector mounted on the carriage to detect a first position of the displacement member; and a second detector mounted on the apparatus body to detect a second position of the displacement member, wherein the supply controller detects and retains a differential supply amount corresponding to a displacement amount of the displacement member between the first position and the second position, when the first position of the displacement member is detected with the first detector, the remaining amount of the liquid in the head tank is smaller than when the second position of the displacement member is detected with the second detector, after the printing operation is performed, the supply controller determines whether the displacement member is at a position at which the remaining amount of the liquid in the head tank is smaller than when the displacement member is at the first position, and if the supply controller determines that the displacement member is at the position at which the remaining amount of the liquid in the head tank is smaller than when the displacement member is at the first position, the supply controller controls the liquid feed device to supply the liquid until the first detector detects that the displacement member is at the first position, and after the first detector detects that the displacement member is at the first position, the supply controller controls the liquid feed device to supply the liquid by the differential supply amount from the main tank to the head tank and then the supply controller controls the liquid feed device to stop supply of the liquid.

2. The image forming apparatus of claim 1, wherein, at least one of after end of the printing operation, after end of maintenance operation of the recording head, and on starting up the image forming apparatus, and when the displacement member is at the position at which the remaining amount of the liquid in the head tank is smaller than when the displacement member is at the first position, the supply controller controls the liquid feed device to supply the liquid until the displacement member is placed at the first position or the position at which the remaining amount of the liquid in the head tank is greater than when the displacement member is at the first position.

3. The image forming apparatus of claim 1, wherein, based on whether or not the supply controller measures the consumption amount of the liquid in the head tank at end of the printing operation, the supply controller determines whether or not the displacement member is at the position at which the remaining amount of the liquid in the head tank is smaller than when the displacement member is at the first position.

4. The image forming apparatus of claim 1, wherein the supply controller controls the second detector to detect the displacement member and determines whether or not the displacement member is at the position at which the remaining amount of the liquid in the head tank is smaller than when the displacement member is at the first position.

5. The image forming apparatus of claim 1, wherein, when the image forming apparatus is started up, the supply controller controls the second detector to detect the displacement member, and when the displacement member is at a position at which the remaining amount of the liquid in the head tank is greater than when the displacement member is at the second position, the supply controller detects the differential supply amount.

6. The image forming apparatus of claim 1, wherein the displacement member comprises a detected portion having a certain width in a displacement direction in which the displacement member displaces, the first position of the displacement member detected with the first detector is a position at which the first detector detects an end of the detected portion in the displacement direction, the first detector is disposed at a position at which, when the second detector detects the displacement member, the first detector may detect the detected portion, and when, after maintenance operation, the supply controller detects with the second detector that the displacement member is at the position at which the remaining amount of the liquid in the head tank is greater than when the displacement member is at the first position, the supply controller controls the liquid feed device to reduce the liquid in the head tank until the second detector detects the second position or the first detector detects the first position of the displacement member.

7. The image forming apparatus of claim 1, wherein the displacement member comprises a detected portion having a certain width in a displacement direction in which the displacement member displaces, the first position of the displacement member detected with the first detector is a position at which the first detector detects an end of the detected portion in the displacement direction, the first detector is disposed at a position at which, when the second detector detects the displacement member, the first detector may detect the detected portion, and before start of the printing operation and when the first detector does not detect the detected portion of the displacement member, the supply controller controls the second detector to detect the displacement member.

8. The image forming apparatus of claim 7, wherein, when the supply controller detects with the second detector that the displacement member is at the position at which the remaining amount of the liquid in the head tank is smaller than when the displacement member is at the first position, the supply controller controls the liquid feed device to supply the liquid to the head tank until the first detector detects the first position of the displacement member.

9. The image forming apparatus of claim 1, wherein, when, after end of the printing operation, the printing operation is not resumed for a predetermined time and the displacement member is at the position at which the remaining amount of the liquid in the head tank is smaller than when the displacement member is at the first position, the supply controller controls the liquid feed device to supply the liquid to the head tank until the displacement member is placed at the first position or the position at which the remaining amount of the liquid in the head tank is greater than when the displacement member is at the first position.

10. An image forming apparatus comprising:

an apparatus body;

a recording head to eject liquid droplets;

a head tank to store liquid to be supplied to the recording head;

a carriage mounting the recording head and the head tank;

a main tank to store the liquid to be supplied to the head tank;

a liquid feed device to supply the liquid from the main tank to the head tank;

a supply controller to control driving of the liquid feed device to supply the liquid from the main tank to the head tank;

a displacement member provided at the head tank and displaceable with a remaining amount of the liquid in the head tank;

a first detector mounted on the carriage to detect a first position of the displacement member; and a second detector mounted on the apparatus body to detect a second position of the displacement member, wherein the supply controller detects and retains a differential supply amount corresponding to a displacement amount of the displacement member between the first position and the second position, when the first position of the displacement member is detected with the first detector, the remaining amount of the liquid in the head tank is smaller than when the second position of the displacement member is detected with the second detector, when, during scanning of the carriage, the recording head contacts a recording medium on which the recording head forms an image, the supply controller detects the differential supply amount, and wherein after the printing operation is performed, the supply controller determines whether the displacement member is at a position at which the remaining amount of the liquid in the head tank is smaller than when the displacement member is at the first position, and if the supply controller determines that the displacement member is at the position at which the remaining amount of the liquid in the head tank is smaller than when the displacement member is at the first position, the supply controller controls the liquid feed device to supply the liquid until the first detector detects that the displacement member is at the first position and after the first detector detects that the displacement member is at the first position, the supply controller controls the liquid feed device to supply the liquid by the differential supply amount from the main tank to the head tank and then the supply controller controls the liquid feed device to stop supply of the liquid.

* * * * *